US011710439B2

(12) United States Patent
Minaki et al.

(10) Patent No.: US 11,710,439 B2
(45) Date of Patent: Jul. 25, 2023

(54) SUBPIXEL RENDERING FOR DISPLAY PANELS INCLUDING MULTIPLE DISPLAY REGIONS WITH DIFFERENT PIXEL LAYOUTS

(71) Applicant: Synaptics Incorporated, San Jose, CA (US)

(72) Inventors: Tomoo Minaki, Tokyo (JP); Hirobumi Furihata, Tokyo (JP); Takashi Nose, Kanagawa (JP); Akio Sugiyama, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/678,645

(22) Filed: Feb. 23, 2022

(65) Prior Publication Data

US 2023/0100358 A1 Mar. 30, 2023

Related U.S. Application Data

(60) Provisional application No. 63/248,893, filed on Sep. 27, 2021.

(51) Int. Cl.
*G09G 3/20* (2006.01)

(52) U.S. Cl.
CPC ... *G09G 3/2074* (2013.01); *G09G 2300/0439* (2013.01); *G09G 2310/027* (2013.01); *G09G 2320/0686* (2013.01)

(58) Field of Classification Search
CPC ..... G09G 3/2074; G09G 2300/0439; G09G 2310/027; G09G 2320/0686
See application file for complete search history.

(56) References Cited

U.S. PATENT DOCUMENTS

2021/0065625 A1* 3/2021 Wang ..... G09G 3/2074
2022/0051641 A1* 2/2022 Park ..... H04N 5/2257
2023/0030179 A1* 2/2023 Chen ..... G09G 5/10

* cited by examiner

*Primary Examiner* — Adam R. Giesy
(74) *Attorney, Agent, or Firm* — Ferguson Braswell Fraser Kubasta PC

(57) ABSTRACT

A display driver includes an image processing circuit and a driver circuit. The image processing circuit is configured to: receive input image data corresponding to an input image; generate first subpixel rendered data from a first part of the input image data for a first display region of a display panel using a first setting; and generate second subpixel rendered data from a second part of the input image data for a second display region of the display panel using a second setting different from the first setting. The first pixel layout is different than the second pixel layout. The driver circuit is configured to update the first display region of the display panel based at least in part on the first subpixel rendered data and update the second display region of the display panel based at least in part on the second subpixel rendered data.

22 Claims, 22 Drawing Sheets

SUBPIXEL RENDERING FOR DISPLAY PANELS INCLUDING MULTIPLE DISPLAY REGIONS WITH DIFFERENT PIXEL LAYOUTS

CROSS REFERENCE TO RELATED APPLICATIONS

This application claims benefit under 35 U.S.C. § 119(e) to U.S. Provisional Patent Application Ser. No. 63/248,893, filed on Sep. 27, 2021. U.S. Provisional Patent Application Ser. No. 63/248,893 is incorporated herein by reference in its entirety.

FIELD

This disclosure relates generally to the field of display panels, specifically to subpixel rendering for display panels.

BACKGROUND

Some display panels may include multiple display regions with different pixel layouts. One example is a display panel adapted to installation of under-display (or under-screen) optical elements, such as cameras, proximity sensors, and other optical sensors. Mobile device manufacturers seek to optimize available display area by eliminating any non-display elements on the surface of devices. Elements including but not limited to camera and proximity sensors require dedicated space outside of the display area, which limits the available display area. One option is to place optical elements such as cameras or other optical sensors underneath the display panel. In one example, a front-facing camera or other optical element may be placed underneath the display surface enabling photos to be taken in a "selfie-mode". In some embodiments, pixels above an under-display optical element may be spaced wider than pixels in other areas of the display panel to allow sufficient light to pass through the pixels and reach the under-display optical element. These regions with widely-spaced pixels may be referred to as low-pixel density regions, or regions with low pixels-per-inch (PPI).

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes an image processing circuit and a driver circuit. The image processing circuit configured to receive input image data corresponding to an input image. The image processing circuit is further configured to generate first subpixel rendered data from a first part of the input image data for a first display region of a display panel using a first setting and generate second subpixel rendered data from a second part of the input image data for a second display region of the display panel using a second setting different from the first setting. The first setting is for a first pixel layout of the first display region and the second setting is for a second pixel layout of the second display region. The first pixel layout is different than the second pixel layout. The driver circuit is configured to update the first display region of the display panel based at least in part on the first subpixel rendered data and update the second display region of the display panel based at least in part on the second subpixel rendered data.

In one or more embodiments, a display device is provided. The display device includes a display panel and a display driver. The display panel includes a first display region with a first pixel layout and a second display region with a second pixel layout different than the first pixel layout. The display driver is configured to receive input image data corresponding to an input image to be displayed on a display panel. The display driver is further configured to generate first subpixel rendered data from a first part of the input image data for the first display region using a first setting for the first pixel layout of the first display region and generate second subpixel rendered data from a second part of the input image data for the second display region using a second setting for the second pixel layout of the second display region. The second setting is different from the first setting. The display driver is further configured to update the first display region of the display panel based at least in part on the first subpixel rendered data and update the second display region of the display panel based at least in part on the second subpixel rendered data.

In one or more embodiments, a method for driving a display panel is provided. The method includes receiving input image data corresponding to an input image. The method further includes generating first subpixel rendered data from a first part of the input image data for a first display region of a display panel using a first setting and generating second subpixel rendered data from a second part of the input image data for a second display region of the display panel using a second setting different from the first setting. The first setting is for a first pixel layout of the first display region and the second setting is for a second pixel layout of the second display region. The first pixel layout is different than the second pixel layout. The method further includes: updating the first display region of the display panel based at least in part on the first subpixel rendered data; and updating the second display region of the display panel based at least in part on the second subpixel rendered data.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are shown in the appended drawings. It is to be noted, however, that the appended drawings illustrate only exemplary embodiments, and are therefore not to be considered limiting of inventive scope, as the disclosure may admit to other equally effective embodiments.

Figure 1:
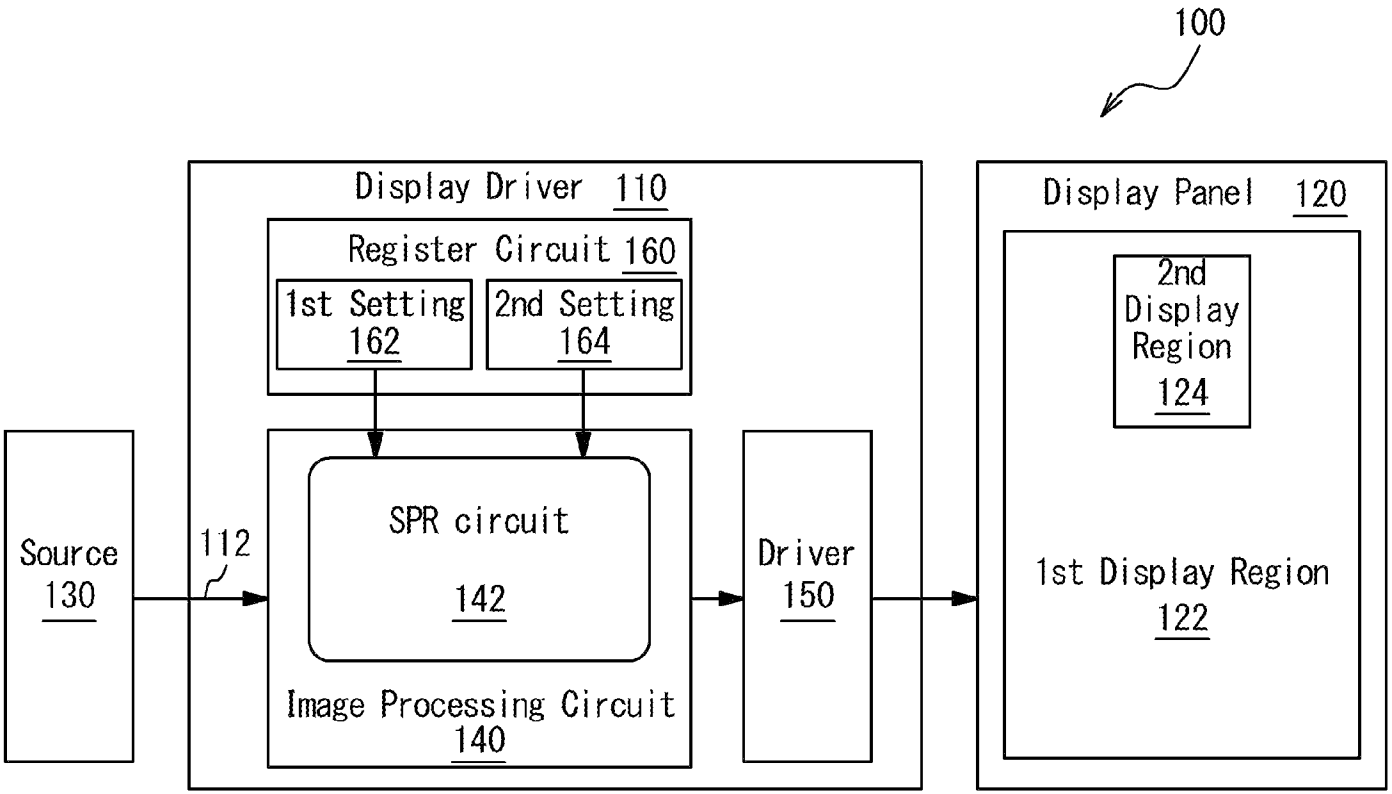
FIG. 1 shows an example configuration of a display system, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

A display panel may include two or more display regions with different pixel layouts (or geometries). The pixel layout difference may include the difference in the pixel density (which may be measured as pixel-per-inch (PPI)) and/or the difference in the spacing between pixels. The pixel layout difference may additionally or instead include a difference in one or more of the size, configuration, arrangement, and number of subpixels in each pixel.

In one example implementation, a display panel may include a low pixel density region under which an under-display optical element (e.g., a camera, a proximity sensor or other optical sensors) is disposed. The low pixel density region may have a lower pixel density than the pixel density of the rest of the active region of the display panel, which may be referred to as nominal pixel density region. The low pixel density region may be configured to allow sufficient external light to reach the under-display optical element. In one implementation, an under-display camera is disposed underneath the low pixel density region and configured to capture an image through the low pixel density region.

In some embodiments, driving or updating a display panel based on input image data may involve applying subpixel rendering to input image data. Subpixel rendering is a technique to increase the apparent resolution of a display device by rendering subpixels (e.g., red (R) subpixels, green (G) subpixels, and blue (B) subpixels) based on the physical pixel layout. Subpixel rendering may determine or calculate graylevels of respective subpixels based on input image data and the physical pixel layout.

One issue is that subpixel rendering may cause image artifact, distortion and/or color shift in embodiments where a display panel that includes two or more display regions with different pixel layout. The present disclosure provides various techniques for mitigating the image artifact, distortion and/or color shift potentially caused by subpixel rendering in the display image displayed on a display panel that includes display regions with different pixel layouts.

In one or more embodiments, a display driver includes an image processing circuit and a driver circuit. The image processing circuit is configured to receive input image data corresponding to an input image. The image processing circuit is further configured to generate first subpixel rendered data from a first part of the input image data for a first display region of a display panel using a first setting, and generate second subpixel rendered data from a second part of the input image data for a second display region of the display panel using a second setting. The first setting is for a first pixel layout of the first display region, and the second setting is for a second pixel layout of the second display region. The first pixel layout is different than the second pixel layout, and the first setting is different from the second setting. The driver circuit is configured to update the first display region of the display panel based at least in part on the first subpixel rendered data, and update the second display region of the display panel based at least in part on the second subpixel rendered data. Using the first setting and the second setting for the first pixel layout and the second pixel layout, respectively, may effectively mitigate distortion and/or color shift potentially caused by the subpixel rendering. In the following, a description is given of detailed embodiments of the present disclosure.

FIG. 1 shows an example configuration of a display system 100, according to one or more embodiments. In the shown embodiment, the display system 100 includes a display driver 110 and a display panel 120. Examples of the display panel 120 include organic light emitting diode (OLED) display panels, micro light emitting diode (LED) panels, liquid crystal display (LCD) panels, and display panels implementing various other suitable display technologies.

The display driver 110 is configured to drive or update the display panel 120 based on image data 112 received from a source 130. The image data 112 corresponds to an input image to be displayed on the display panel 120. The image data 112 may include pixel data for respective pixels of the display image. Pixel data for each pixel may include gray-levels of respective colors (e.g., red (R), green (G), and blue (B)) of the pixel. In embodiments where the image data 112 is in an RGB format, the pixel data for each pixel includes graylevels for red, green, and blue (which may be hereinafter referred to as R graylevel, G graylevel, and B graylevel, respectively). The source 130 may be a processor (e.g., an application processor and a central processing unit (CPU)), an external controller, a host, or other devices configured to provide the image data 112.

The display panel 120 includes a plurality of display regions with different pixel layouts. In the shown embodiment, the display panel 120 includes a first display region 122 with a first pixel layout and a second display region 124 with a second pixel layout that is different from the first pixel layout. The first pixel layout and the second pixel layout may be different in the pixel density (e.g., as measured by pixel-per-inch (PPI)). In some embodiments, the pixel density of the second display region 124 is lower than the pixel density of the first display region 122 and one or more under-display optical elements (e.g., a camera, a proximity sensor or other optical sensors) are disposed underneath the second display region 124. The low pixel density of the second display region 124 may allow sufficient light to pass through the second display region 124 and reach the under-display optical elements. The first pixel layout and the second pixel layout may be additionally or instead different in the size, configuration, arrangement and/or number of subpixels in each pixel. In other embodiments, the display panel 120 may further include one or more display regions with pixel layouts different from the first pixel layout and the second pixel layout.

In one or more embodiments, the display driver 110 includes an image processing circuit 140, a driver circuit 150, and a register circuit 160. The image processing circuit 140 is configured to apply image processing to image data 112 received from the source 130 to generate voltage data that specifies voltage levels of data voltages with which respective subpixels of the display panel 120 are to be updated. As discussed later in detail, the image processing includes subpixel rendering. The image processing may further include color adjustment, scaling, overshoot/undershoot driving, gamma transformation, and other image processes. The driver circuit 150 is configured to generate the data voltages based on the voltage data received from the image processing circuit 140 and update the respective subpixels of the display panel 120 with the generated data voltages. The register circuit 160 is configured to store settings of the image processing performed by the image processing circuit 140.

The image processing circuit 140 includes a subpixel rendering (SPR) circuit 142. The image processing circuit 140 is configured to provide input image data to the SPR circuit 142, where the input image data is based on the image data 112 received from the source 130. The input image data may be the image data 112 as is or image data generated by applying desired image processing (e.g., color adjustment, scaling, and other image processing) to the image data 112. The SPR circuit 142 is configured to apply subpixel rendering to the input image data.

In one or more embodiments, the SPR circuit 142 is configured to perform the subpixel rendering for the first display region 122 and the second display region 124 with different settings. The register circuit 160 is configured to store a first setting 162 for the first pixel layout of the first display region 122 and a second setting 164 for the second pixel layout of the second display region 124. The first setting 162 may specify a particular set of one or more operations (e.g., that include one or more algorithms and/or computations) of the subpixel rendering to be performed for the first display region 122 and the second setting 164 may specify a particular set of one or more operations (e.g., that include one or more algorithms and/or computations) of the subpixel rendering to be performed for the second display region 124. Details of the first setting 162 and the second setting 164 will be described later. The first setting 162 is different from the second setting 164 as the second pixel layout of the second display region 124 is different from the first pixel layout of the first display region 122.

The SPR circuit 142 is configured to generate first subpixel rendered data by applying subpixel rendering to a first part of the input image data for the first display region 122 using the first setting 162 and generate second subpixel rendered data from a second part of the input image data for a second display region 124 of the display panel using the second setting 164. The image processing circuit 140 is further configured to generate first voltage data for the first display region 122 based on the first subpixel rendered data and generate second voltage data for the second display region 124 based on the second subpixel rendered data. The driver circuit 150 is configured to update the subpixels of the first display region 122 based at least in part on the first voltage data for the first display region 122 and update the subpixels of the second display region 124 based at least in part on the second voltage data for the second display region 124. As the first voltage data for the first display region 122 is based on the first subpixel rendered data, the driver circuit 150 is configured to update the first display region 122 of the display panel 120 based at least in part on the first subpixel rendered data. Correspondingly, as the second voltage data for the second display region 124 is based on the second subpixel rendered data, the driver circuit 150 is configured to update the second display region 124 of the display panel 120 based at least in part on the first subpixel rendered data. Using the first setting 162 and the second setting 164 for the first display region 122 and the second display region 124, respectively, enables the SPR circuit 142 to achieve improved subpixel rendering for the first display region 122 and the second display region 124, effectively mitigating distortion and/or color shift potentially caused by the subpixel rendering.

Figure 2:
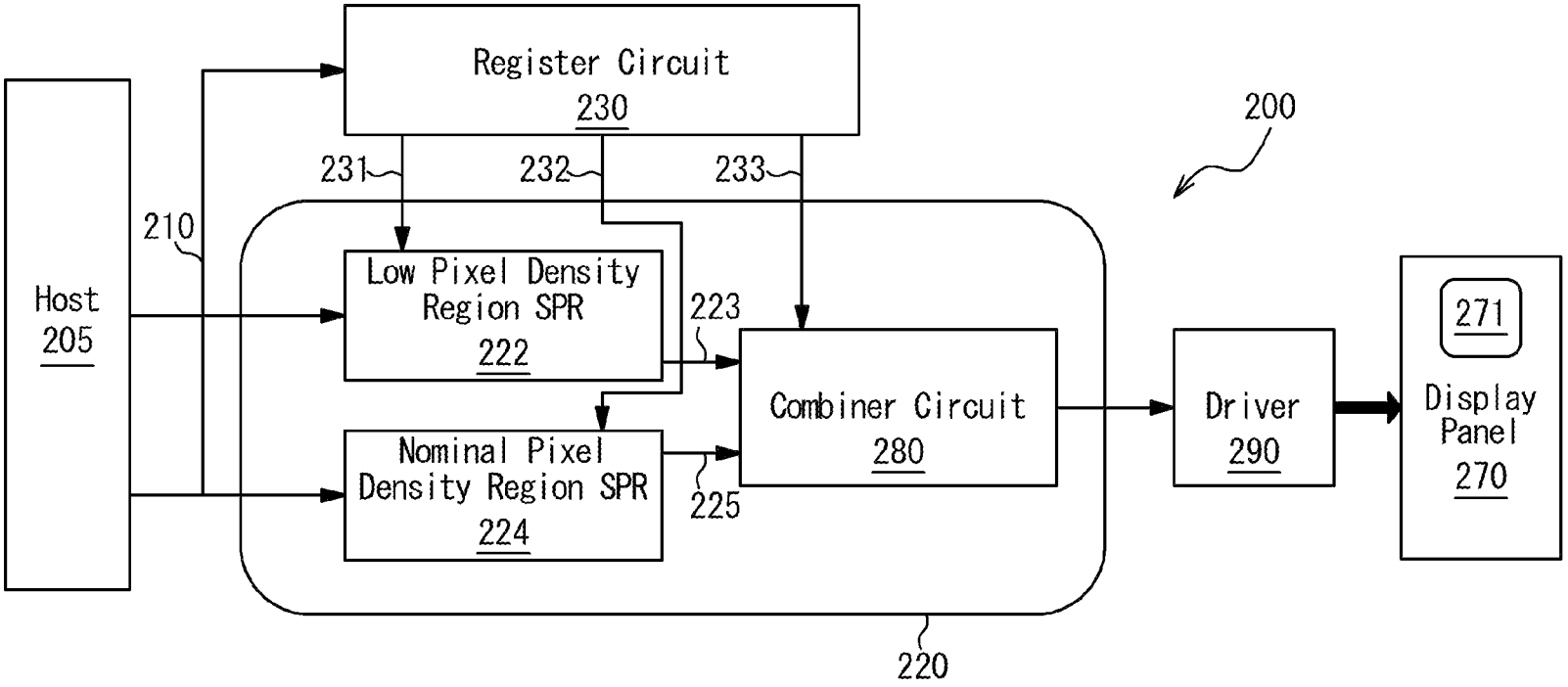
FIG. 2 shows an example configuration of a display system, according to one or more embodiments.

FIG. 2 shows an example configuration of a display system 200, according to one or more embodiments. The display system 200 may be one embodiment of the display system 100 of FIG. 1. The display system 200 includes a display panel 270, which may be one embodiment of the display panel 120 of FIG. 1. In the shown embodiment, the display panel 270 includes a low pixel density region 271 with a pixel density lower than the pixel density of the region outside of the low pixel density region 271 of the display panel 270. The region outside of the low pixel density region 271, which has a nominal pixel density, may be referred to as nominal pixel density region. The nominal pixel density region may be one embodiment of the first display region 122 of FIG. 1, and the low pixel density region 271 may be one embodiment of the second display region 124 of FIG. 1. In the nominal pixel density region, the pixel density may the same as or less than the pixel density of an input image, which is provided to the display system 200 in the form of input image data 210.

The input image data 210 is input from a host device 205 to an SPR circuit 220. The host device 205 may be one embodiment of the source 130 of FIG. 1. In the SPR circuit 220, the input image data 210 is coupled to a low pixel density region SPR circuit 222 and to a nominal pixel density region SPR circuit 224. The input image data 210 is coupled to a register circuit 230. The register circuit 230 may provide a setting 231 (which may be one embodiment of the second setting 164 of FIG. 1) to configure the low pixel density region SPR circuit 222. The register circuit 230 may provide a setting 232 (which may be one embodiment of the first setting 162 of FIG. 1) to configure a nominal pixel density region SPR circuit 224. The register circuit 230 may decode the input image data 210 and, based upon decoded pixel location data, may provide a location setting 233 to a combiner circuit 280 to indicate the shape and location of the low pixel density region 271. One possible value of the location setting 233 may indicate the input image data 210 corresponds to a location in the low pixel density region 271. A second possible value of the location setting 233 may indicate the input image data 210 corresponds to a location in the nominal pixel density region of the display panel 270 outside of the low pixel density region 271. A third possible value of the location setting 233 may indicate the input image data 210 corresponds to a boundary between the low pixel density region 271 and the nominal pixel density region.

The low pixel density region SPR circuit 222 may receive input image data 210 and, based on the setting 231, may apply image processing to generate low pixel density region output 223. The image processing performed in the low pixel density region SPR circuit 222 may include subpixel rendering for the low pixel density region 271. The setting 231 may specify particular algorithms or image computations to be performed in the low pixel density region SPR circuit 222. The low pixel density region output 223 may contain information to drive subpixels of the low pixel density region 271 with the received input image data 210. The low pixel density region SPR circuit 222 may apply a decimation or averaging algorithm to map the larger number of received pixels in input image data 210 into the smaller number of pixels in the low pixel density region 271 of the display panel 270. The low pixel density region output 223 may include subpixel rendered data for the low pixel density region 271.

The nominal pixel density region SPR circuit 224 may receive the input image data 210 and, based on the setting 232, apply image processing to generate nominal pixel density region output 225. The image processing performed in the nominal pixel density region SPR circuit 224 may include subpixel rendering for the nominal pixel density region. The setting 232 may specify particular algorithms or image computations to be performed in the nominal pixel density region SPR circuit 224. The nominal pixel density region output 225 may contain information to drive subpixels with the received input image data 210. The nominal pixel density region SPR circuit 224 may apply any desired image processing algorithms to the input image data 210 to generate the desired image response in areas of the nominal pixel density, those areas outside the low pixel density region 271 of the display panel 270. The nominal pixel density region output 225 may include subpixel rendered data for the nominal pixel density region.

A combiner circuit 280 takes as input the low pixel density region output 223, the nominal pixel density region output 225, and the location setting 233. For pixel locations with the location setting 233 set to a value indicating a pixel location in the low pixel density region 271, the combiner circuit 280 may output the low pixel density region output 223 to a driver 290. For pixel locations with the location setting 233 set to a value indicating a pixel location in the nominal pixel density region, the combiner circuit 280 may output the nominal pixel density region output 225 to the driver 290. For pixel locations with the location setting 233 set to a value indicating a pixel location at the boundary between the low pixel density region 271 and the nominal pixel density region, the combiner circuit 280 may apply specialized image processing to reduce visible artifacts in the boundary between the low pixel density region 271 and the nominal pixel density region.

Figure 3:
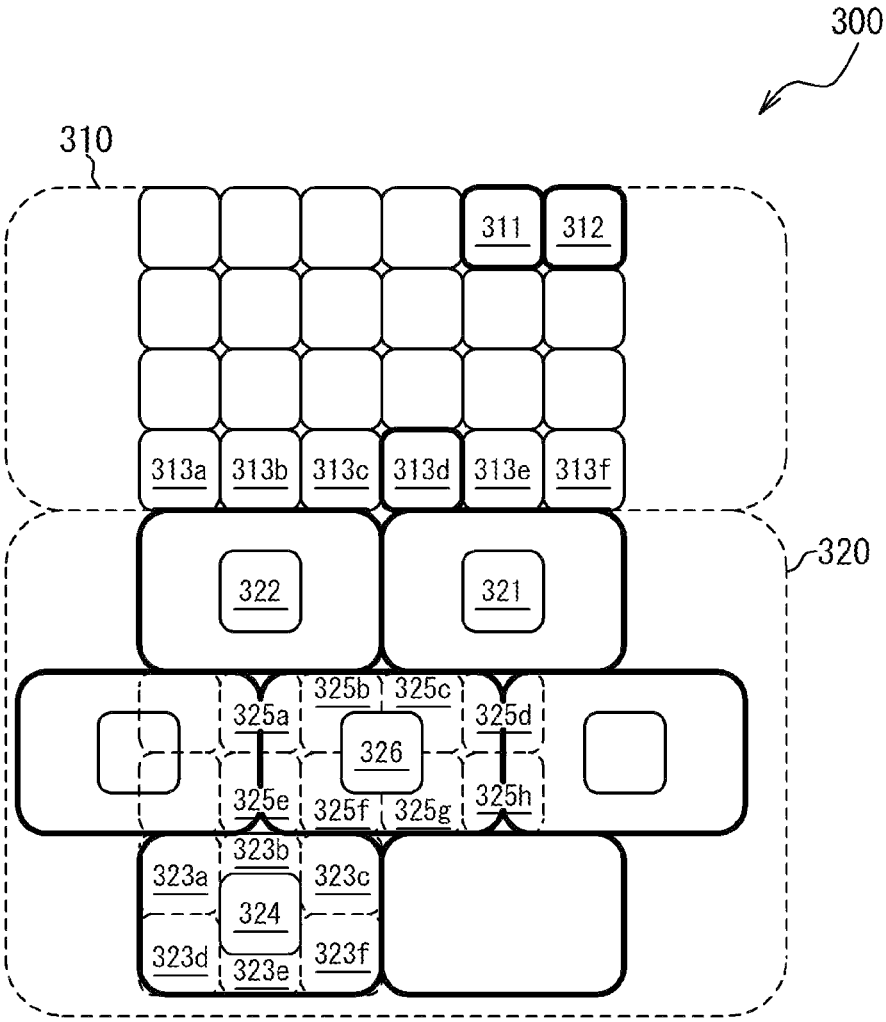
FIG. 3 shows an example embodiment of a display panel including a low pixel density region and a nominal pixel density region.

FIG. 3 shows an example embodiment of a display panel 300 including a low pixel density region 320 and a nominal pixel density region 310. The display panel 300 may be one embodiment of the display panel 120 of FIG. 1. The density of pixels in the nominal pixel density region 310 may be the same as or less than that of the input image. In the nominal pixel density region 310, individual pixels are shown as rounded squares, including but not limited to pixels 311, 312, 313*a*, 313*b*, 313*c*, 313*d*, 313*e*, and 313*f*. Pixels in the nominal pixel density region 310 may be other shapes, including but not limited to circles, hexagons, rectangles or any other regular geometric shape.

In the low pixel density region 320, individual pixels are spaced further apart than in nominal pixel density region 310. Pixels 321 and 322 are separated in the horizontal direction by a distance 3 times the distance between pixels 311 and 312. This specific example should not be considered as limiting embodiments with other distances between pixels. Pixels in low pixel density region 320 may be separated by a distance which is greater than or less than the separation distance shown in FIG. 3.

Pixel 324 in the low pixel density region 320 is shown alongside one embodiment in which pixels of the nominal pixel density must be processed to generate a single pixel in the low pixel density region 320. These six pixels (323*a*, 323*b*, 323*c*, 323*d*, 323*e*, 323*f*) represent input image information which is processed in the low pixel density region SPR circuit 222 to generate information to drive subpixels with the desired image data for pixel 324. These six pixels may be present in the input image information but may not be physically present in the display panel 270 but are shown here to demonstrate concepts of the display system. In some embodiments, the low pixel density region SPR circuit 222 may perform a decimation of pixels at nominal pixel density to transform the 6 pixels of information at nominal pixel density into the subpixel information to drive input image data 210 onto single low pixel density pixel 324. In other embodiments, the low pixel density region SPR circuit 222 may perform an averaging operation of data at nominal pixel density to transform the 6 pixels of information into the subpixel information to drive the input image data 210 onto single low pixel density pixel 324. In other embodiments, the low pixel density region SPR circuit 222 may utilize other signal processing algorithms to transform the 6 pixels of information at the nominal pixel density into the subpixel information for pixel 324.

Pixel 326 represents another embodiment of the relationship between the density of nominal density pixels and the low pixel density region 320 pixels. Pixel 326 overlaps with 8 nominal density pixels, shown as input pixels 325*a*, 325*b*, 325*c*, 325*d*, 325*e*, 325*f*, 325*g* and 325*h*. In this and other embodiments, the low pixel density region SPR circuit 222 may transform the 8 nominal density pixels into the single pixel 326. This transformation may include a decimation computation, an averaging operation or other algorithm to represent the 8 nominal density pixels 325*a*, 325*b*, 325*c*, 325*d*, 325*e*, 325*f*, 325*g* and 325*h* by a single low density pixel 326.

Other embodiments of the display system may include pixels of different shapes than those shown here, including but not limited to rectangles, squares, hexagons or other regular polygons. The transformation of multiple pixels at the nominal density into a lower density in the low pixel density region 320 may involve computations of a wide range of input image pixels. Computations may involve more pixels or fewer pixels than those shown here. Multiple pixels at the nominal density may overlap with single pixels in the low pixel density region 320 in different patterns than shown in these examples and continue to practice the disclosed display system.

Pixels 313*a*, 313*b*, 313*c*, 313*d*, 313*e*, 313*f*, 321 and 322 exist on a boundary between the low pixel density region 320 and the nominal pixel density region 310. Additional image processing may be applied to these boundary pixels. In some embodiments, pixel information for boundary pixels may be averaged with adjacent pixels to smooth discontinuities. In other embodiments, pixel information for boundary pixels may be filtered with a window function. The combiner circuit 280 may adjust luminance values for boundary pixels based on the location setting 233.

Figure 4:
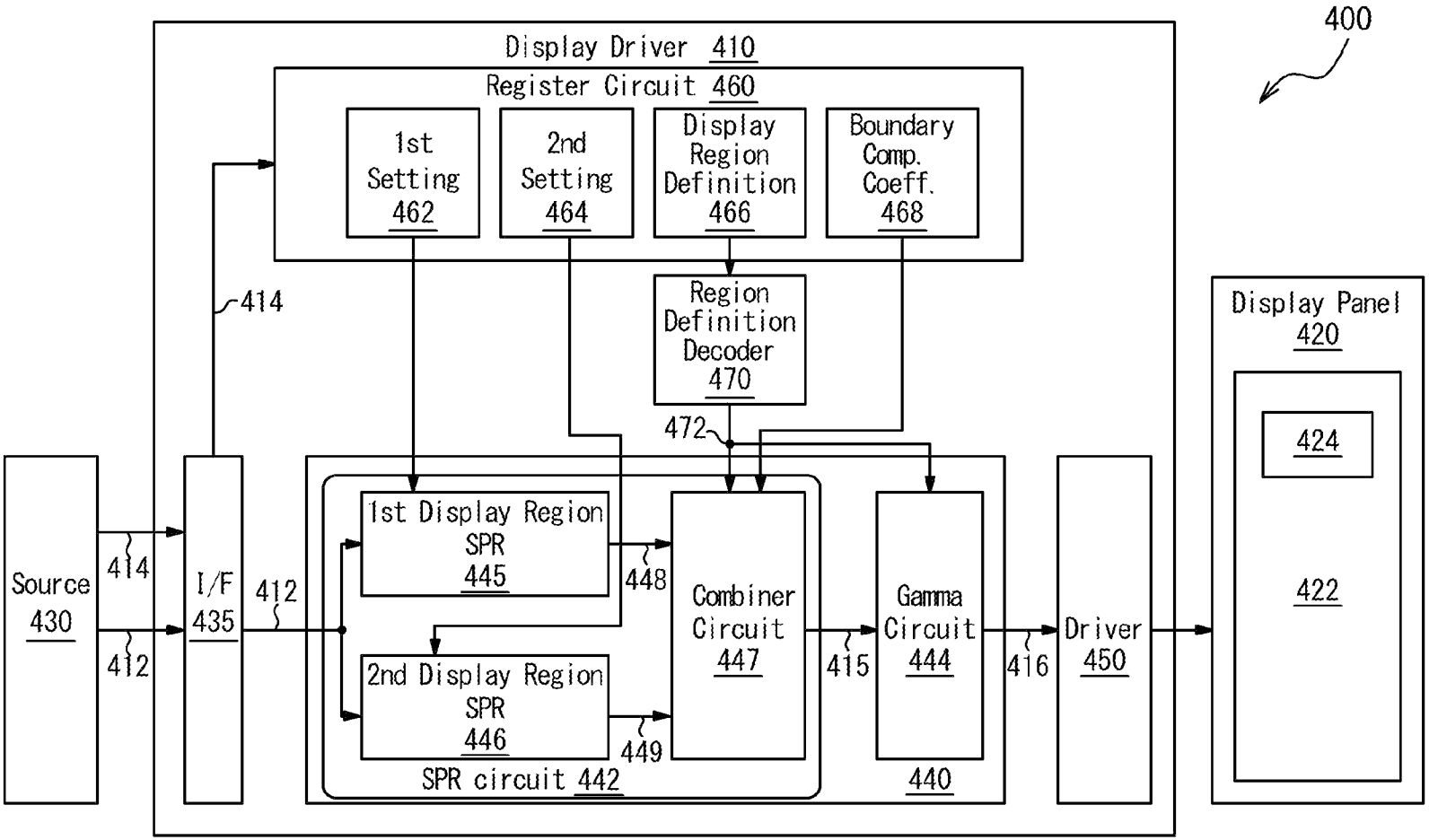
FIG. 4 is a block diagram showing a display system, according to other embodiments.

FIG. 4 is a block diagram showing a display system 400, according to other embodiments. The display system 400 may be one embodiment of the display system 100 of FIG. 1. In the shown embodiment, the display system 400 include a display driver 410 and a display panel 420. The display driver 410 is configured to drive or update the display panel 420 based on image data 412 received from a source 430, which may be a processor (e.g., an application processor and a central processing unit (CPU)), an external controller, a host, or other devices configured to provide the image data 412. The image data 412 may include pixel data for respective pixels of an input image to be displayed on the display panel 420. The pixel data for a pixel may include graylevels of respective colors (e.g., red, green, and blue) of the pixel.

The display panel 420 includes a first display region 422 with a first pixel layout and a second display region 424 with a second pixel layout that is different from the first pixel layout. In the shown embodiment, the pixel density of the second display region 424 is lower than the pixel density of the first display region 422. In some embodiments, one or more under-display optical elements (not shown) may be disposed underneath the second display region 424 while the second display region 424 is configured to allow sufficient light to pass through the second display region 424 and reach the under-display optical elements. Examples of the under-display optical element include cameras, proximity sensors, and other optical sensors.

In one or more embodiments, the display driver 410 includes an interface (I/F) circuit 435, an image processing circuit 440, a driver circuit 450, a register circuit 460, and a region definition decoder 470. The image processing circuit 440, the driver circuit 450, and the register circuit 460 may be embodiments of the image processing circuit 140, the driver circuit 150, and the register circuit 160 of FIG. 1, respectively.

The interface circuit 435 is configured to receive the image data 412 from the source 430 and forward the image data 412 to the image processing circuit 440. The interface circuit 435 may be further configured to receive a setting update 414 from the source 430 and update settings stored in the register circuit 460 as indicated by the setting update 414.

The image processing circuit 440 is configured to apply desired image processing to the image data 412 received from the source 430 to generate voltage data 416 that specifies voltage levels of data voltages with which respective subpixels of the display panel 420 are to be updated. In one or more embodiments, the image processing performed by the image processing circuit 440 includes subpixel rendering. The image processing may further include color adjustment, scaling, overshoot/undershoot driving, gamma transformation, and other image processes.

The driver circuit 450 is configured to update the respective subpixels of the display panel 420 based on the voltage data 416 received from the image processing circuit 440. In one implementation, the driver circuit 450 may be configured to generate and provide data voltages to the respective subpixels of the display panel 420 such that the data voltages have voltage levels as specified by the voltage data 416.

The register circuit 460 is configured to store settings used in the image processing to be performed by the image processing circuit 440. In the shown embodiment, the settings stored in the register circuit 460 include a first setting 462, a second setting 464, and a display region definition 466. The first setting 462 may specify a particular algorithm and/or computation of the subpixel rendering to be performed for the first display region 422 and the second setting 464 may specify a particular algorithm and/or computation of the subpixel rendering to be performed for the second display region 424. The display region definition 466 includes information that defines the first display region 422 and the second display region 424. The display region definition 466 may indicate the shape, location, dimensions (e.g., the width and height) and/or other spatial information of the second display region 424.

The register circuit 460 may be further configured to store boundary compensation coefficients 468 used in subpixel rendering for subpixels at the boundary between the first display region 422 and the second display region 424. In one or more embodiments, a selected one of the boundary compensation coefficients 468 may be applied in subpixel rendering for each subpixel located at the boundary between the first display region 422 and the second display region 424 to mitigate an image artifact at the boundary. Details of the use of the boundary compensation coefficients 468 in the subpixel rendering will be given later.

The region definition decoder 470 is configured to decode the display region definition 466 to generate a region indication signal 472. The region indication signal 427 indicates in which of the first display region 422 and the second display region 424 the subpixel of interest in the image processing performed by the image processing circuit 440 is located. The region indication signal 472 may be one embodiment of the location setting 233 described in relation to FIG. 2.

In one or more embodiments, the image processing circuit 440 includes an SPR circuit 442 and a gamma circuit 444. The image processing circuit 440 is configured to provide input image data to the SPR circuit 442, where the input image data is based on the image data 412 received from the source 430. The input image data may be the image data 412 as is or image data generated by applying desired image processing (e.g., color adjustment, scaling, and other image processing) to the image data 412. The SPR circuit 442 is configured to apply subpixel rendering to the input image data.

In the shown embodiment, the SPR circuit 442 includes a first display region SPR circuit 445, a second display region SPR circuit 446, and a combiner circuit 447.

The first display region SPR circuit 445 is configured to receive a first part of the input image data for the first display region 422 and apply, based on the first setting 462, subpixel rendering to the first part of the input image data to generate first subpixel rendered data 448. The first subpixel rendered data 448 may include graylevels of the subpixels in the first display region 422.

The second display region SPR circuit 446 is configured to receive a second part of the input image data for the second display region 424 and apply, based on the second setting 464, subpixel rendering to the second part of the input image data to generate second subpixel rendered data 449. The second subpixel rendered data 449 may include graylevels of the subpixels in the second display region 424.

The combiner circuit 447 is configured to generate resulting subpixel rendered data 415 by combining the first subpixel rendered data 448 and the second subpixel rendered data 449. The combiner circuit 447 may be configured to output, based on the region indication signal 472, the first subpixel rendered data 448 as the resulting subpixel rendered data 415 for the subpixels in the first display region 422 and output the second subpixel rendered data 449 as the resulting subpixel rendered data 415 for the subpixels in the second display region 424. The combiner circuit 447 may be further configured to apply a selected one of the boundary compensation coefficients 468 to the graylevel indicated by the first subpixel rendered data 448 or the second subpixel rendered data 449 for each subpixel at the boundary between the first display region 422 and the second display region 424 in generating the resulting subpixel rendered data 415. The selection of the boundary compensation coefficient 468 for each subpixel at the boundary may be based on the location of each subpixel. As discussed later in detail, the application of the boundary compensation coefficients 468 may mitigate an image artifact which potentially occur at the boundary between the first display region 422 and the second display region 424.

The gamma circuit 444 is configured to apply gamma transformation to the resulting subpixel rendered data 415 to generate the voltage data 416. In embodiments where the first display region 422 and the second display region 424 are different in the pixel density, the gamma transformation may be performed with different "gamma curves" between the first display region 422 and the second display region 424. The "gamma curve" referred herein is the correlation between the graylevels indicated by the resulting subpixel rendered data 415 and the voltage levels indicated by the voltage data 416. In one embodiment, the gamma curves for the first display region 422 and the second display region 424 are determined depending on the ratio of the pixel density of the second display region 424 to the pixel density of the first display region 422. For example, in embodiments where the pixel density of the second display region 424 is X times of the pixel density of the first display region 422 where X is a number between zero and one, non-inclusive, the gamma curves for the first display region 422 and the second display region 424 are determined such that the luminance of subpixels of the second display region 424 is 1/X times of the luminance of subpixels of the first display region 422 for a fixed graylevel and a fixed color. The gamma curves thus determined reduce or eliminate the difference in the brightness between the images displayed in the first display region 422 and the second display region 424.

In the following, a detailed description is given of example subpixel rendering performed by the SPR circuit 442, according to one or more embodiments.

Figure 5:
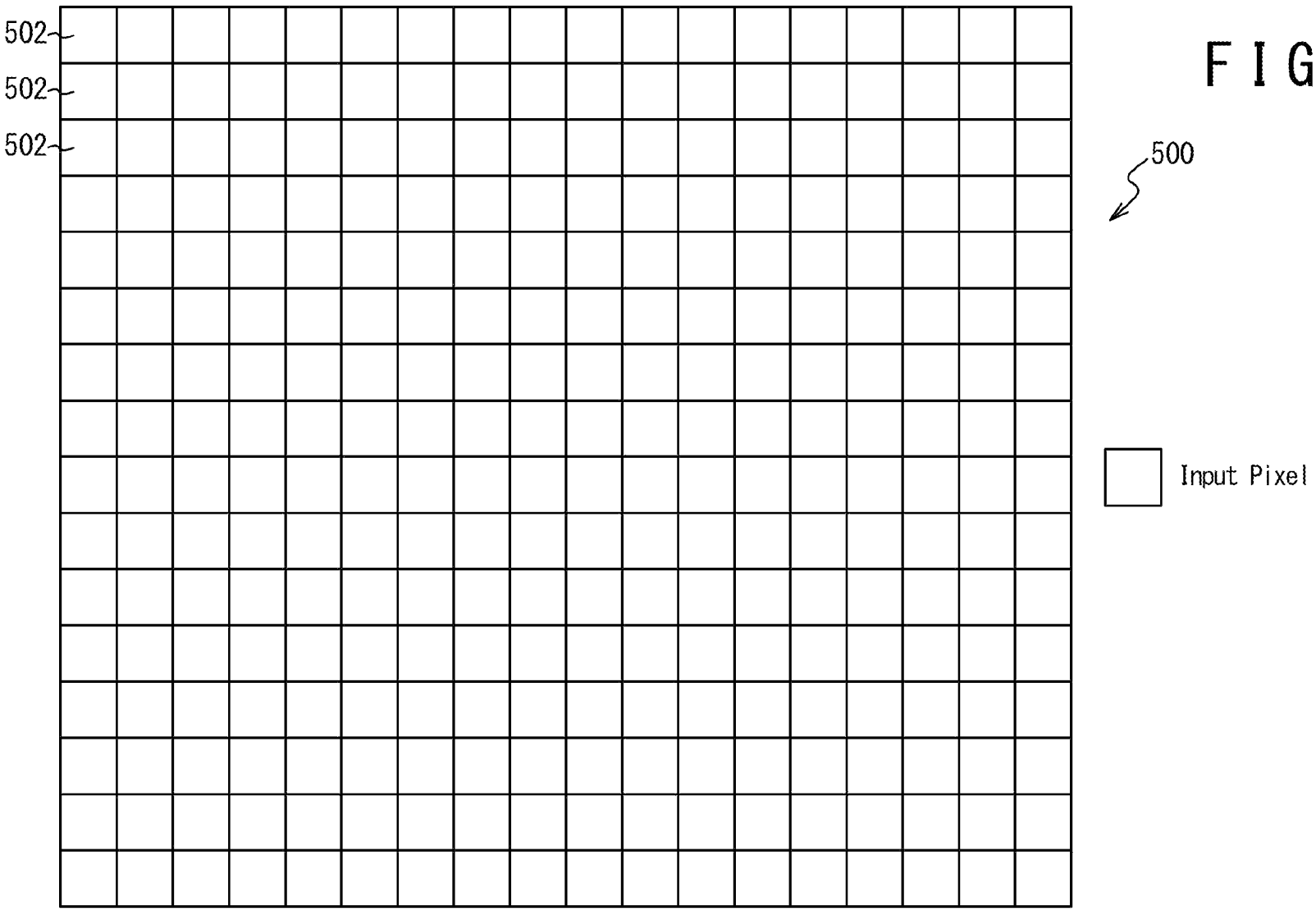
FIG. 5 shows an example input image corresponding to input image data, according to one or more embodiments.

FIG. 5 shows an example input image, denoted by 500, that corresponds to the input image data provided to the SPR circuit 442, according to one or more embodiments. It is noted that the input image data may be the image data 412 as is or image data generated by applying desired image processing to the image data 412. In the shown embodiment, the input image 500 includes input pixels 502 arrayed in rows and columns. In the shown embodiment, each input pixel 502 is defined in a square shape. In other embodiments, the input pixels 502 may be defined in a different shape, such as a rectangular shape, a diamond shape, a parallelogram shape, and other shapes determined such that the input pixels 502 fill the whole input image. The input image data includes graylevels for red, green, and blue (which may be referred to as R, G, and B graylevels, respectively) of each input pixel 502.

Figure 6:
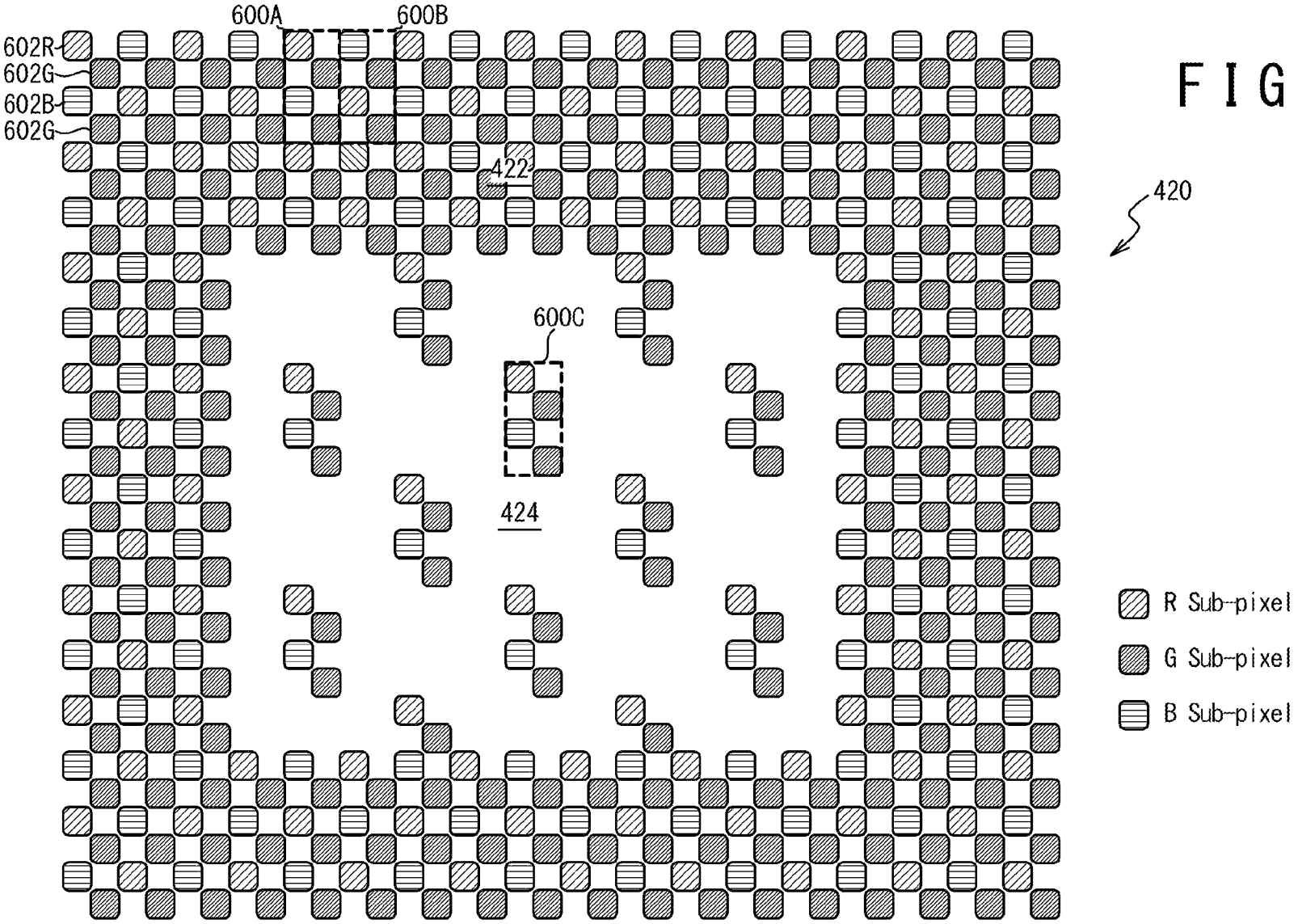
FIG. 6 shows example pixel layouts of a first display region and a second display region of a display panel, according to one or more embodiments.
Figure 7B:
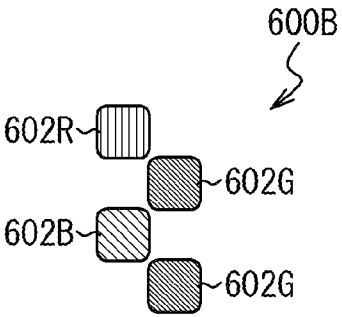
FIG. 7B shows another example configuration of a pixel, according to one or more embodiments.
Figure 7A:
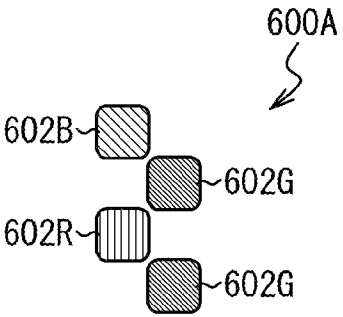
FIG. 7A shows an example configuration of a pixel, according to one or more embodiments.

FIG. 6 shows example pixel layouts of the first display region 422 and the second display region 424 of the display panel 420, according to one or more embodiments. In the shown embodiment, the first display region 422 include pixels 600A and 600B each including one red (R) subpixel 602R, two green (G) subpixels 602G, and one blue (B) subpixel 602B. FIGS. 7A and 7B show example configurations of the pixels 600A and 600B, respectively, according to one or more embodiments. As shown in FIG. 7A, the B subpixel 602B and the R subpixel 602R are disposed in the left column of the pixel 600A and the two G subpixel 602G are disposed in the right column. The two G subpixel 602G are positioned shifted from the B subpixel 602B and the R subpixel 602R in the vertical direction. As shown in FIG. 7B, the pixel 600B is configured similarly to the pixel 600A except for that the positions of the R subpixel 602R and the B subpixel 602B are switched with each other. As shown in FIG. 6, the pixels 600A and 600B are alternately arranged in the vertical direction and the horizontal direction in the first display region 422.

The second display region 424 includes pixels 600C. In the shown embodiment, the pixels 600C are configured identically to the pixels 600A, which each includes one R subpixel 602R, two G subpixels 602G, and one B subpixel 602B. In the shown embodiment, the pixels 600A and 600B are disposed adjacent to one another in the first display region 422 while the pixels 600C are spaced from one another in the second display region 424. Accordingly, the pixel density of the second display region 424 is lower than the pixel density of the first display region 422. In the shown embodiment, the pixel density of the second display region 424 is one fourth of the pixel density of the first display region 422.

Figure 8:
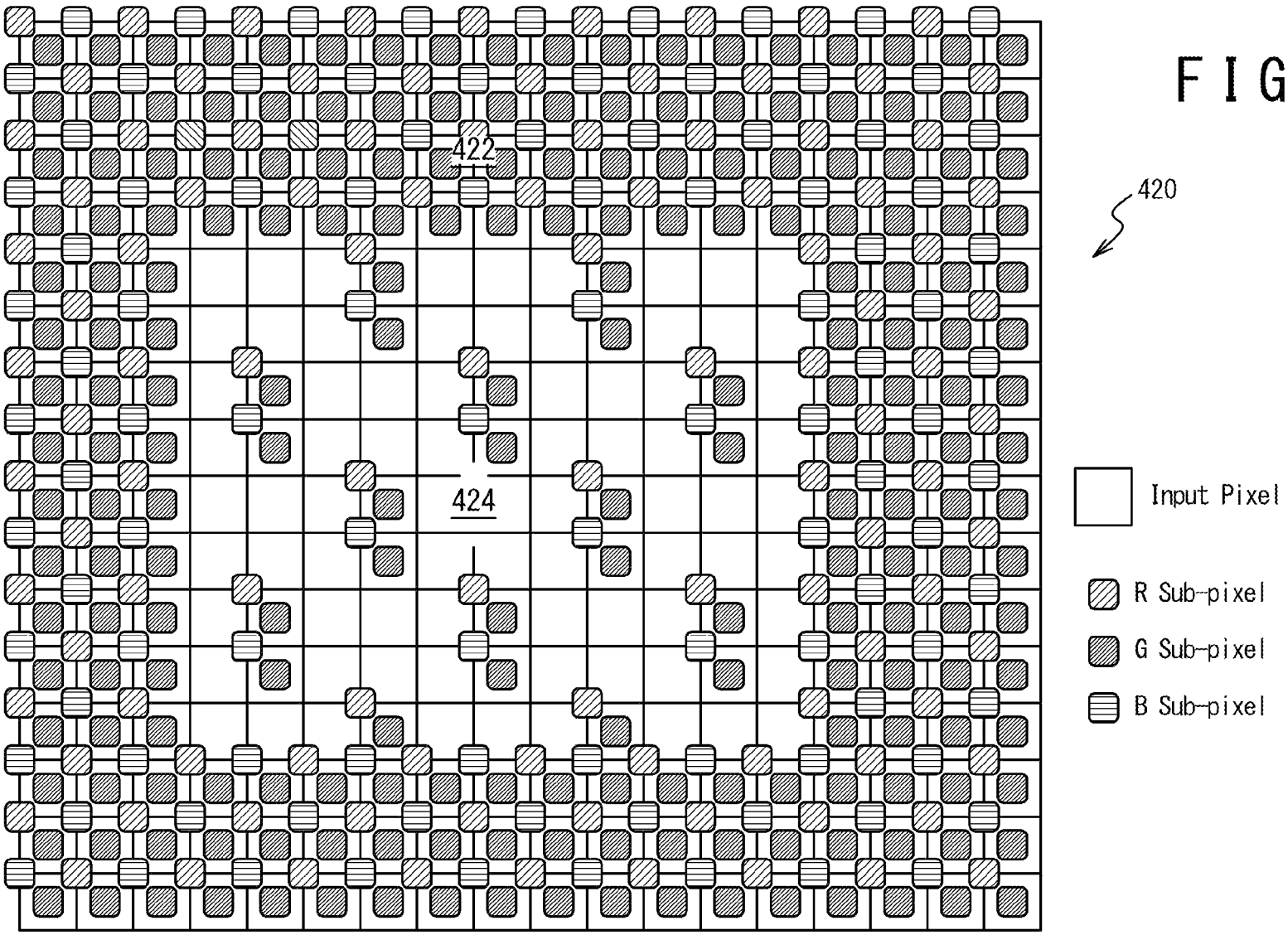
FIG. 8 is an illustration showing example mapping of input pixels of an input image to red (R) subpixels, green (G) subpixels, and blue (B) subpixels of a display panel, according to one or more embodiments.

FIG. 8 is an illustration showing example mapping of the input pixels of the input image (shown in FIG. 5) to the R subpixels, the G subpixels, and the B subpixels of the display panel 420 (shown in FIG. 6), according to one or more embodiments. In the shown embodiment, the input pixels are defined such that the R subpixels and the B subpixels are disposed at the corners of the corresponding input subpixels while the G subpixels are disposed at the centers of the corresponding input subpixels.

In the subpixel rendering, the graylevel of each R subpixel of the display panel 420 is determined based on R graylevels of one or more neighboring input pixels. Correspondingly, the graylevel of each G subpixel of the display panel 420 is determined based on the G graylevels of one or more neighboring input pixels and the graylevel of each B subpixel is determined based on B graylevels of one or more neighboring input pixels. In the following, a detailed description is first given of example determination (or calculation) of the graylevels of the R subpixels of the display panel 420 in the subpixel rendering.

Figure 9:
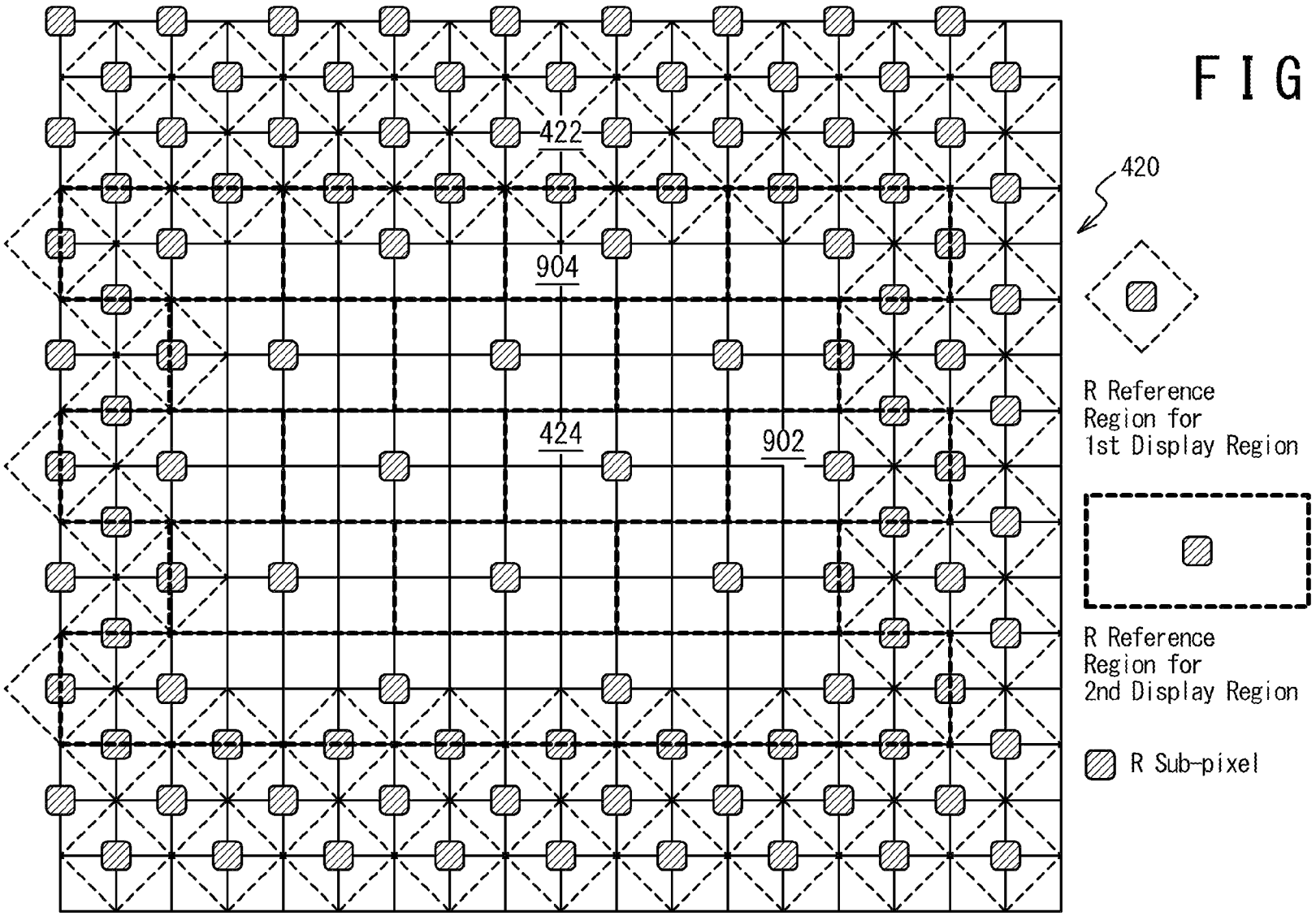
FIG. 9 shows example R reference regions defined for R subpixels of a display panel, according to one or more embodiments.

FIG. 9 shows example R reference regions defined for the respective red (R) subpixels of the display panel 420, according to one or more embodiments. A reference region is a region that overlaps one or more neighboring pixels used to calculate a graylevel of a particular subpixel. An R reference region is a reference region for a particular R subpixel, a B reference region is a reference region for a B particular subpixel, and a G reference region is a reference region for a particular G subpixel. The determination of the graylevel of each R subpixel of the display panel 420 involves defining an R reference region for each R subpixel of the display panel 420 and determining the graylevel of each R subpixel based at least in part on R graylevels of input pixels of the input image, the input pixels being at least partially overlapped by the R reference region. The R reference regions are defined such that the positions of respective R reference regions map to the positions of the corresponding R subpixels of the display panel 420. In one implementation, the R reference regions may be defined such the geometric center of each R reference region is positioned on the corresponding R subpixel of the display panel 420. The graylevel of each R subpixel of the display panel 420 may be determined based at least in part on the R graylevels of the input pixels that are at least partially overlapped by the R reference region defined for each R subpixel of the display panel 420.

In one or more embodiments, the R reference regions for the R subpixels in the first display region 422 are defined differently from the R reference regions for the R subpixels in the second display region 424. In one implementation, the definition of the R reference regions for the R subpixels in the first display region 422 is indicated by the first setting 462 (shown in FIG. 4) stored in the register circuit 460 and the definition of the R reference regions for the R subpixels in the second display region 424 is indicated by the second setting 464 (also shown in FIG. 4) stored in the register circuit 460. In this case, the first setting 462 and the second setting 464 may be defined such that the definitions of the R reference regions are different between the first display region 422 and the second display region 424. The definition of the R reference regions for each of the first display region 422 and the second display region 424 may include the shape, area, one or more dimensions (e.g., width and height) or other spatial features of the R reference regions. Differently defining the R reference regions for the first display region 422 and the second display region 424 may mitigate image artifact, distortion and/or color shift in display images acquired by the subpixel rendering in view of the different pixel layouts of the first display region 422 and the second display region 424, effectively improving the quality of the display images.

In one implementation, the shape of the R reference regions for the first display region 422 is different from the shape of the R reference regions for the second display region 424. In the embodiment shown in FIG. 9, the R reference regions for the first display region 422 are defined in a rhombic (or diamond) shape while the R reference regions for the second display region 424 are defined in a rectangular shape. Further, the area of the R reference regions for the second display region 424, whose pixel density is lower than the first display region 422, is larger than the area of the R reference regions for the second display region 424.

Figure 10:
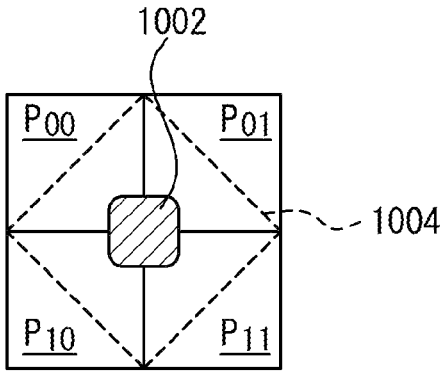
FIG. 10 shows an example calculation performed in subpixel rendering to determine a graylevel of an R subpixel, according to one or more embodiments.

FIG. 10 shows an example calculation performed in the subpixel rendering to determine the graylevel of an R subpixel 1002 in the first display region 422 based on a R reference region 1004 defined for the R subpixel 1002, according to one or more embodiments. In some embodiments, the graylevel of an R subpixel 1002 in the first display region 422 may be calculated by the first display region SPR circuit 445 (shown in FIG. 4) and incorporated in the first subpixel rendered data 448.

In one embodiment, the graylevel of the R subpixel 1002 is calculated based at least in part on the R graylevels of input pixels that are at least partially overlapped by the R reference region 1004. In the shown embodiment, the graylevel of the R subpixel 1002 is calculated based at least in part on the R graylevels of input pixels $P_{00}$, $P_{01}$, $P_{10}$, and $P_{11}$ that are partially overlapped by the R reference region 1004. The calculation of the graylevel of the R subpixel 1002 may be further based on fractions of overlaps of the R reference region 1004 over the input pixels $P_{00}$, $P_{01}$, $P_{10}$, and $P_{11}$.

In some embodiments, the graylevel of the R subpixel 1002 may be calculated as the γ-th root of a weighted sum of the γ-th powers of the R graylevels of input pixels $P_{00}$, $P_{01}$, $P_{10}$, and $P_{11}$. In one implementation, the graylevel of the R subpixel 1002 may be calculated in accordance with the following formula (1):

$$R_{spr_{1002}} = \sqrt[\gamma]{w_{00} \cdot R_{in_00}^{\gamma} + w_{01} \cdot R_{in_01}^{\gamma} + w_{10} \cdot R_{in_10}^{\gamma} + w_{11} \cdot R_{in_11}^{\gamma}}, = \left(w_{00} \cdot R_{in_00}^{\gamma} + w_{01} \cdot R_{in_01}^{\gamma} + w_{10} \cdot R_{in_10}^{\gamma} + w_{11} \cdot R_{in_11}^{\gamma}\right)^{1/\gamma}, \quad (1)$$

where $R_{spr_1002}$ is the graylevel of the R subpixel 1002, $R_{in_ij}$ is the R graylevel of the input pixel $P_{ij}$, $w_{ij}$ is the weight assigned to the input pixel $P_{ij}$, and γ is the gamma value of the display system 400. The gamma value γ may be 2.2, which is one of standard gamma values for display systems. In one implementation, the weight $w_{ij}$ is the ratio of the portion of the input pixel $P_{ij}$ overlapped by the R reference region 1004 to the total area of the R reference region 1004. The weights $w_{00}$, $w_{01}$, $w_{10}$, and $w_{11}$ assigned to the input pixels $P_{00}$, $P_{01}$, $P_{10}$ and $P_{11}$ are determined based on fractions of overlaps of the R reference region 1004 over the input pixels $P_{00}$, $P_{01}$, $P_{10}$, and $P_{11}$, respectively. In one implementation, the weights $w_{00}$, $w_{01}$, $w_{10}$, and $w_{11}$ are determined as the ratios of the areas of overlapped portions of the input pixels $P_{00}$, $P_{01}$, $P_{10}$, and $P_{11}$ to the total area of the R reference region 1004, respectively, the overlapped portions of the input pixels $P_{00}$, $P_{01}$, $P_{10}$, and $P_{11}$ being overlapped by the R reference region 1004.

In embodiments where the areas of the overlapped portions of the input pixels $P_{00}$, $P_{01}$, $P_{10}$, and $P_{11}$ overlapped by the R reference region 1004 are equal to one another, the graylevel of the R subpixel 1002 may be calculated as the γ-th root of the average of the γ-th powers of the R graylevels of the input pixels $P_{00}$, $P_{01}$, $P_{10}$, and $P_{11}$. In the embodiment shown in FIG. 10, the ratios of the areas of the overlapped portions of the input pixels $P_{00}$, $P_{01}$, $P_{10}$, and $P_{11}$ to the area of the R reference region 1004 are all 0.25. Accordingly, the graylevel of the R subpixel 1002 may be calculated as follows:

$$R_{spr_1002}=(0.25R_{in_{00}}^{\gamma}+0.25R_{in_{01}}^{\gamma}+0.25R_{in_10}^{\gamma}+0.25R_{in_11}^{\gamma})^{1/\gamma}. \quad (2)$$

The graylevels of other R subpixels in the first display region 422 may be calculated similarly to the R subpixel 1002.

Figure 11:
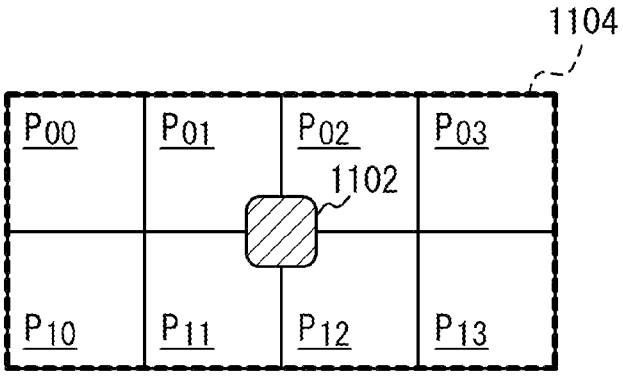
FIG. 11 shows an example calculation performed in subpixel rendering to determine a graylevel of an R subpixel, according to one or more embodiments.

FIG. 11 shows an example calculation performed in the subpixel rendering to determine the graylevel of an R subpixel 1102 in the second display region 424 of the display panel 420 based on an R reference region 1104 defined for the R subpixel 1102, according to one or more embodiments. The graylevel of the R subpixel 1102 in the second display region 424 may be calculated in a similar manner to the graylevel of the R subpixel 1002 in the first display region 422 (shown in FIG. 10) except for that the definition of the R reference region 1104 is different from the definition of the R reference region 1004. In some embodiments, the graylevel of an R subpixel 1102 in the second display region 424 may be calculated by the second display region SPR circuit 446 (shown in FIG. 4) and incorporated in the second subpixel rendered data 449.

In one embodiment, the graylevel of the R subpixel 1102 is calculated based at least in part on the R graylevels of input pixels that are at least partially overlapped by the R reference region 1104. In the shown embodiment, the graylevel of the R subpixel 1102 is calculated based at least in part on the R graylevels of input pixels $P_{00}$, $P_{01}$, $P_{02}$, $P_{03}$, $P_{10}$, $P_{11}$, $P_{12}$, and $P_{13}$. The calculation of the graylevel of the R subpixel 1102 may be further based on fractions of overlaps of the R reference region 1104 over the input pixels $P_{00}$, $P_{01}$, $P_{02}$, $P_{03}$, $P_{10}$, $P_{11}$, $P_{12}$, and $P_{13}$.

In some embodiments, the graylevel of the R subpixel 1102 may be calculated as the γ-th root of a weighted sum of the γ-th powers of the R graylevels of input pixels $P_{00}$, $P_{01}$, $P_{02}$, $P_{03}$, $P_{10}$, $P_{11}$, $P_{12}$, and $P_{13}$. In one implementation, the graylevel of the R subpixel 1102 may be calculated in accordance with the following formula (3):

$$R_{spr_1102}=(w_{00}\cdot R_{in_00}^{\gamma}+w_{01}\cdot R_{in_01}^{\gamma}+w_{02}\cdot R_{in_02}^{\gamma}+w_{03}\cdot R_{in_03}^{\gamma}w_{10}\cdot R_{in_10}^{\gamma}+w_{11}\cdot R_{in_11}^{\gamma}+w_{12}\cdot R_{in_12}^{\gamma}+w_{13}\cdot R_{in_13}^{\gamma})^{1/\gamma}, \quad (3)$$

where $R_{spr_1102}$ is the graylevel of the R subpixel 1102, $R_{in_ij}$ is the R graylevel of the input pixel $P_{ij}$, $w_{ij}$ is the weight assigned to the input pixel $P_{ij}$, and γ is the gamma value of the display system 400. In one implementation, the weight $w_{ij}$ is the ratio of the portion of the input pixel $P_{ij}$ overlapped by the R reference region 1104 to the total area of the R reference region 1104. The weights $w_{00}$, $w_{01}$, $w_{02}$, $w_{03}$, $w_{10}$, $w_{11}$, $w_{12}$, and $w_{13}$ assigned to the input pixels $P_{00}$, $P_{01}$, $P_{02}$, $P_{03}$, $P_{10}$, $P_{11}$, $P_{12}$, and $P_{13}$ are determined based on fractions of overlaps of the R reference region 1004 over the input pixels $P_{00}$, $P_{01}$, $P_{02}$, $P_{03}$, $P_{10}$, $P_{11}$, $P_{12}$, and $P_{13}$, respectively. In one implementation, the weights $w_{00}$, $w_{01}$, $w_{02}$, $w_{03}$, $w_{10}$, $w_{11}$, $w_{12}$, and $w_{13}$ are determined as the ratios of the areas of overlapped portions of the input pixels $P_{00}$, $P_{01}$, $P_{02}$, $P_{03}$, $P_{10}$, $P_{11}$, $P_{12}$, and $P_{13}$ to the total area of the R reference region 1004, respectively, the overlapped portions of the input pixels $P_{00}$, $P_{01}$, $P_{02}$, $P_{03}$, $P_{10}$, $P_{11}$, $P_{12}$, and $P_{13}$ being overlapped by the R reference region 1004.

In embodiments where the areas of the portions of the input pixels $P_{00}$, $P_{01}$, $P_{02}$, $P_{03}$, $P_{10}$, $P_{11}$, $P_{12}$, and $P_{13}$ overlapped by the R reference region 1104 are equal to one another, the graylevel of the R subpixel 1102 may be calculated as the γ-th root of the average of the γ-th powers of the R graylevels of the input pixels $P_{00}$, $P_{01}$, $P_{02}$, $P_{03}$, $P_{10}$, $P_{11}$, $P_{12}$, and $P_{13}$. In the embodiment shown in FIG. 11, the ratios of the areas of the overlapped portions of the input pixels $P_{00}$, $P_{01}$, $P_{02}$, $P_{03}$, $P_{10}$, $P_{11}$, $P_{12}$, and $P_{13}$ to the area of the R reference region 1104 are all 0.125. Accordingly, the graylevel of the R subpixel 1102 may be calculated as follows:

$$R_{spr_1102}=(0.125R_{in_00}^{\gamma}+0.125R_{in_01}^{\gamma}+0.125R_{in_02}^{\gamma}+0.125R_{in_03}^{\gamma}+0.125R_{in_10}^{\gamma}+0.125R_{in_11}^{\gamma}+0.125R_{in_12}^{\gamma}+0.125R_{in_13}^{\gamma})^{1/\gamma}, \quad (4)$$

The graylevels of other R subpixels in the second display region 424 may be calculated similarly to the R subpixel 1102.

In embodiments where the shape of the R reference regions is different between the first display region 422 and the second display region 424 (for example as shown in FIG. 9), the R reference regions defined for the first display region 422 may mismatch with the R reference regions defined for the second display region 424 at the boundary between the first display region 422 and the second display region 424. More specifically, an R reference region defined for an R subpixel in the second display region 424 may overlap one or more R reference regions defined for one or more R subpixels in the first display region 422. If an R reference region defined for an R subpixel in one of the first display region 422 and the second display region 424 overlaps one or more other R reference regions defined for one or more R subpixels in the other of the first display region 422 and the second display region 424, such an R subpixel may be hereinafter referred to as boundary R subpixel.

Figure 12:
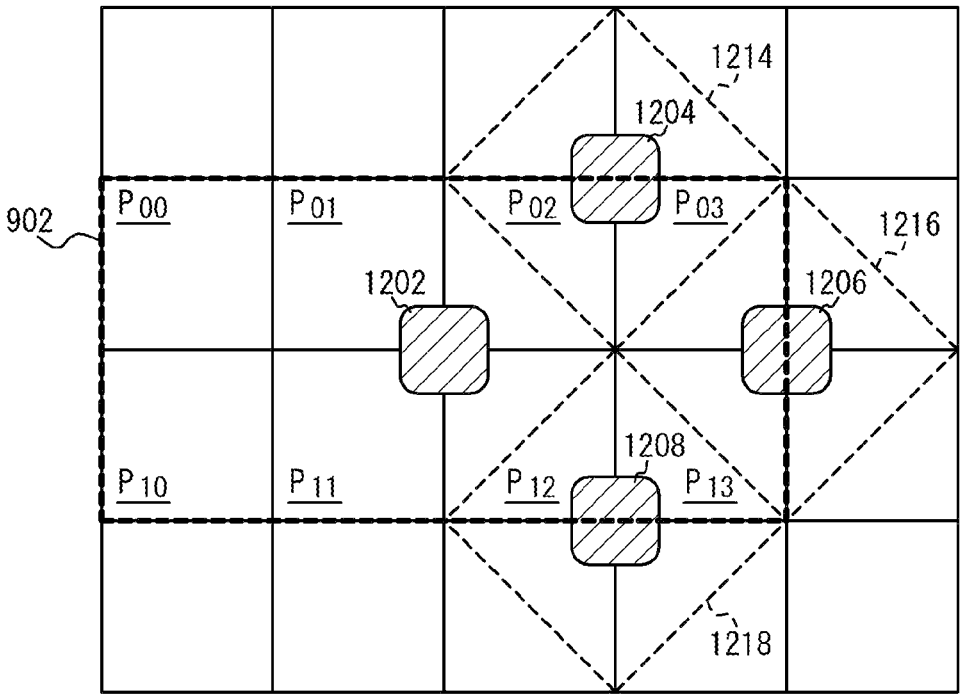
FIG. 12 shows example R reference regions defined for boundary R subpixels, according to one or more embodiments.

FIG. 12 shows an example R reference region 902 (also shown in FIG. 9) defined for a boundary R subpixel 1202 in the second display region 424 at the boundary between the first display region 422 and the second display region 424, according to one or more embodiments. In the shown embodiment, the R reference region 902 partially overlaps R reference regions 1214, 1216, and 1218 that are respectively defined for boundary R subpixels 1204, 1206, and 1208 in the first display region 422. The overlap of the R reference region 902 over the R reference regions 1214, 1216, and 1218 may result in that the graylevel of the boundary R subpixel 1202 in the second display region 424 and the graylevels of the boundary R subpixels 1204, 1206, and 1208 in the first display region 422 duplicately incorporate R graylevel information of portions of input pixels $P_{02}$, $P_{03}$, $P_{12}$, and $P_{13}$ on which the R reference region 902 overlaps the R reference regions 1214, 1216, and 1218, causing an image artifact at the boundary between the first display region 422 and the second display region 424.

Figure 13:
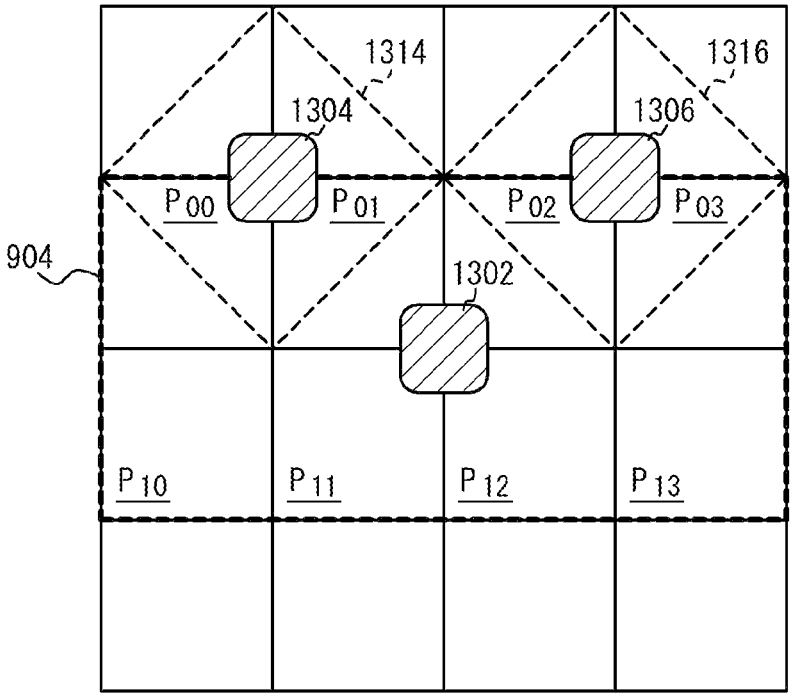
FIG. 13 shows example R reference regions defined for boundary R subpixels, according to one or more embodiments.

FIG. 13 shows another example R reference region 904 (also shown in FIG. 9) defined for another boundary R subpixel 1302 in the second display region 424 at the boundary between the first display region 422 and the second display region 424, according to one or more embodiments. In the illustrated embodiments, the R reference region 904 partially overlaps R reference regions 1314 and 1316 defined for boundary R subpixels 1304 and 1306 in the first display region 422, respectively. As is the case with FIG. 12, the overlap of the R reference region 904 over the R reference regions 1314 and 1316 may result in that the graylevel of the boundary R subpixel 1302 in the second display region 424 and the graylevels of the boundary R subpixels 1304 and 1306 in the first display region 422 duplicately incorporate R graylevel information of portions of input pixels $P_{00}$, $P_{01}$, $P_{02}$, and $P_{03}$ on which the R reference region 904 overlaps the R reference regions 1314 and 1316, causing an image artifact at the boundary between the first display region 422 and the second display region 424.

One approach to mitigate the image artifact may be to modify the shapes of R reference regions defined for the boundary R subpixels, which are positioned at the boundary between the first display region 422 and the second display region 424, such that the R reference regions defined for the boundary R subpixels do not overlap any other R reference regions. This approach may however complicate the shapes of R reference regions defined for the boundary R subpixels, undesirably increasing the calculation amount needed for the subpixel rendering.

In one or more embodiments, the image artifact at the boundary between the first display region 422 and the second display region 424 is mitigated by applying boundary compensation coefficients to the graylevels of at least some of the boundary R subpixels. In some embodiments, boundary compensation coefficients may be applied to the graylevels of the boundary R subpixels in the second display region 424. In other embodiments, boundary compensation coefficients may be applied to the graylevels of the boundary R subpixels in both the first display region 422 and the second display region 424. In still other embodiments, boundary compensation coefficients may be applied to the graylevels of the boundary R subpixels in the first display region 422. The boundary compensation coefficients may be empirically predetermined and stored in the register circuit 460 as the boundary compensation coefficients 468 shown in FIG. 4.

In one implementation, the graylevels of the boundary R subpixels in the second display region 424 may be determined by first determining base graylevels of boundary R subpixels as the γ-th root of a weighted sum of the γ-th powers of the R graylevels of the corresponding input pixels as described above (e.g., in accordance with the above-described formula (3) or (4)) and determining the final graylevels of the boundary R subpixels by applying boundary compensation coefficients to the base graylevels. In some embodiments, the second display region SPR circuit 446 (shown in FIG. 4) may be configured to generate the second subpixel rendered data 449 such that the second subpixel rendered data 449 incorporates the base graylevels of the boundary R subpixels in the second display region 424. In such embodiments, the combiner circuit 447 may be configured to apply the boundary compensation coefficients to the base graylevels of the boundary R subpixels in the second display region 424 to determine the final graylevels of the boundary R subpixels. The combiner circuit 447 may be further configured to incorporate the final graylevels of the boundary R subpixels into the resulting subpixel rendered data 415.

For the boundary R subpixel 1202 in the second display region 424 shown in FIG. 12, for example, a base graylevel of the boundary R subpixel 1202 is determined as the γ-th root of a weighted sum of the γ-th powers of the R graylevels of input pixels $P_{00}$, $P_{01}$, $P_{02}$, $P_{03}$, $P_{10}$, $P_{11}$, $P_{12}$, and $P_{13}$ which are overlapped by the R reference region 902 defined for the boundary R subpixel 1202. In one implementation, the base graylevel of the boundary R subpixel 1202 is determined as follows:

$$R_{base_1202}=(0.125R_{in_00}^{\gamma}+0.125R_{in_01}^{\gamma}+0.125R_{in_02}^{\gamma}+0.125R_{in_03}^{\gamma}+0.125R_{in_10}^{\gamma}+0.125R_{in_11}^{\gamma}+0.125R_{in_12}^{\gamma}+0.125R_{in_13}^{\gamma})^{1/\gamma}, \quad (5)$$

where $R_{base_1202}$ is the base graylevel of the boundary R subpixel 1202. The final graylevel of the boundary R subpixel 1202 may be determined by applying a boundary compensation coefficient determined for the boundary R subpixel 1202. In some embodiments, the final graylevel of the boundary R subpixel 1202 is determined by multiplying the base graylevel $R_{base_1202}$ of the boundary R subpixel 1202 by the boundary compensation coefficient determined for the boundary R subpixel 1202. In such embodiments, the final graylevel $R_{spr_1202}$ of the boundary R subpixel 1202 is determined as:

$$R_{spr_1202}=\eta_R \cdot R_{base_1202}, \quad (6)$$

where ηR is the boundary compensation coefficient determined for the boundary R subpixel 1202. In one implementation, the boundary compensation coefficient ηR for the boundary R subpixel 1202 may be empirically determined and stored in the register circuit 460 as part of the boundary compensation coefficients 468. The graylevels of other boundary R subpixels in the first display region 422 and/or the second display region 424 may be calculated similarly to the boundary R subpixel 1202.

The shapes of overlaps of the R reference regions defined for the boundary R subpixels in the second display region 424 over the R reference regions defined for the boundary R subpixels in the first display region 422 may vary depending on the positions of the boundary R subpixels. Referring to FIGS. 12 and 13, for example, the shape of the overlap of the R reference region 902 defined for the boundary R subpixel 1202 in the second display region 424 over the R reference regions 1214, 1216, and 1218 defined for the boundary R subpixels 1204, 1206, and 1208 in the first display region 422 is different from the shape of the overlap of the R reference region 904 defined for the boundary R subpixel 1302 in the second display region 424 over the R reference regions 1314 and 1316 defined for the boundary R subpixels 1304 and 1306 in the first display region 422.

In one or more embodiments, the boundary compensation coefficients are determined in relation to the shapes of the overlaps to mitigate an image artifact between the first display region 422 and the second display region 424. More specifically, in some embodiments, the boundary compensation coefficient applied to the base graylevel of a boundary R subpixel is determined based on the position of the boundary R subpixel. The boundary compensation coefficient applied to the base graylevel of a boundary R subpixel may be selected from the boundary compensation coefficients 468 stored in the register circuit 460 (shown in FIG. 4) based on the position of the boundary R subpixel. The determination or selection of the boundary compensation coefficient based on the position of the boundary R subpixel may effectively mitigate the image artifact at the boundary between the first display region 422 and the second display region 424.

While FIG. 9 shows rhombic R reference regions for the R subpixels in the first display region 422 and rectangular R reference regions for the R subpixels in the second display region 424, the shapes of the R reference regions defined for the R subpixels in the first display region 422 and the second display region 424 may be variously modified depending on implementations. The R reference regions defined for the R subpixels in the first display region 422 may be, but not limited to, squares, rectangles, parallelograms, hexagons, or any other regular polygons. The R reference regions defined for the R subpixels in the second display region 424 may be squares, rhombuses, parallelograms, hexagons, or any other regular polygons.

Figure 14A:
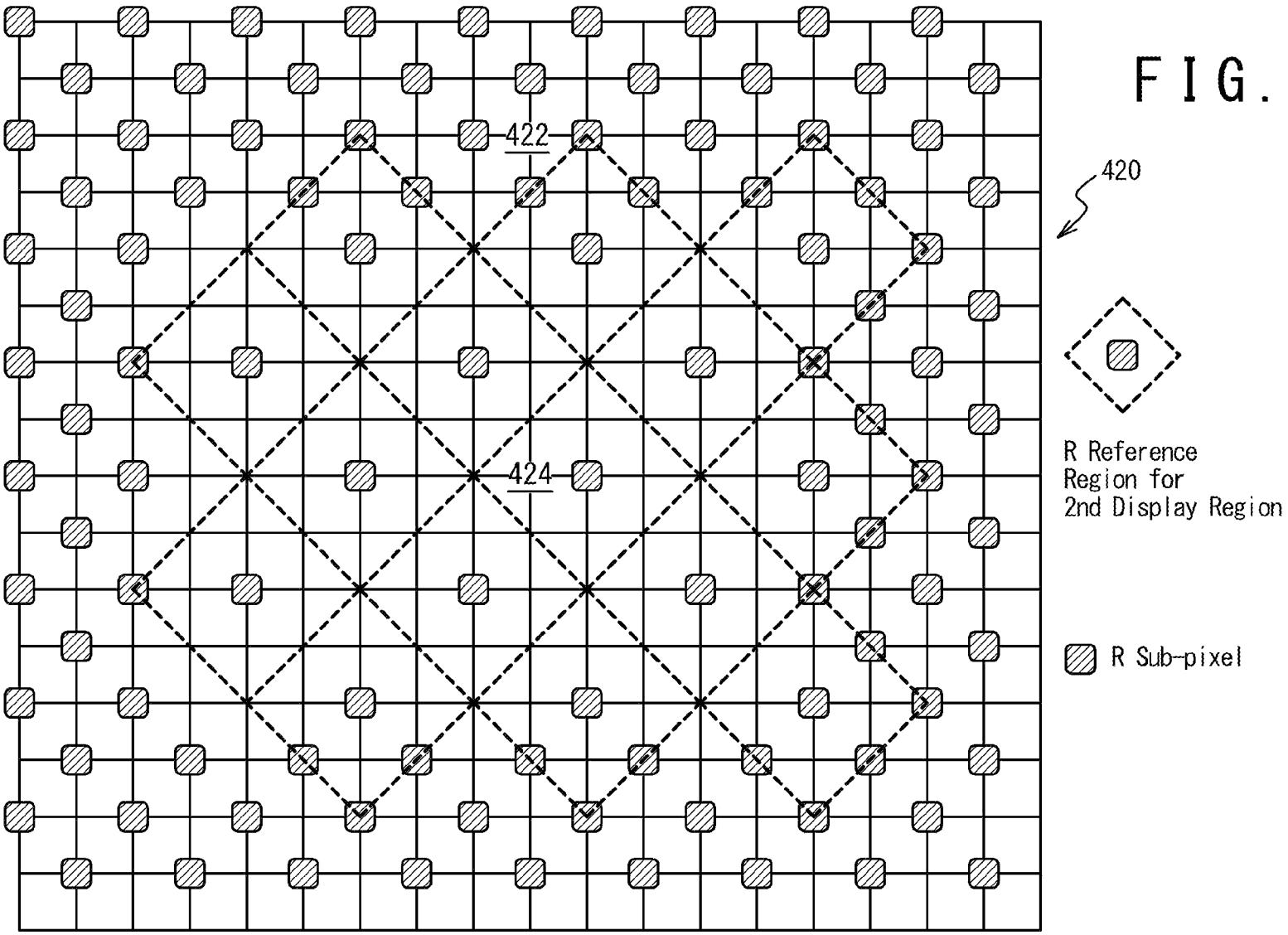
FIG. 14A shows example R reference regions defined for R subpixels, according to one or more embodiments.

FIG. 14A shows example R reference regions defined for the respective R subpixels in the second display region 424, according to one or more embodiments. In the shown embodiment, the R reference regions for the R subpixels in the second display region 424 are defined in a rhombic shape. The R reference regions are defined such that the positions of respective R reference regions map to the positions of the corresponding R subpixels in the second display region 424. In one implementation, the R reference regions may be defined such the geometric center of each R reference region is positioned on the corresponding R subpixel in the second display region 424. The definition of the R reference regions for the R subpixels in the second display region 424 may be indicated by the second setting 464 (also shown in FIG. 4) stored in the register circuit 460. The graylevel of each R subpixel in the second display region 424 may be determined based at least in part on the R graylevels of the input pixels that are at least partially overlapped by the R reference region defined for each R subpixel in the second display region 424.

Figure 14B:
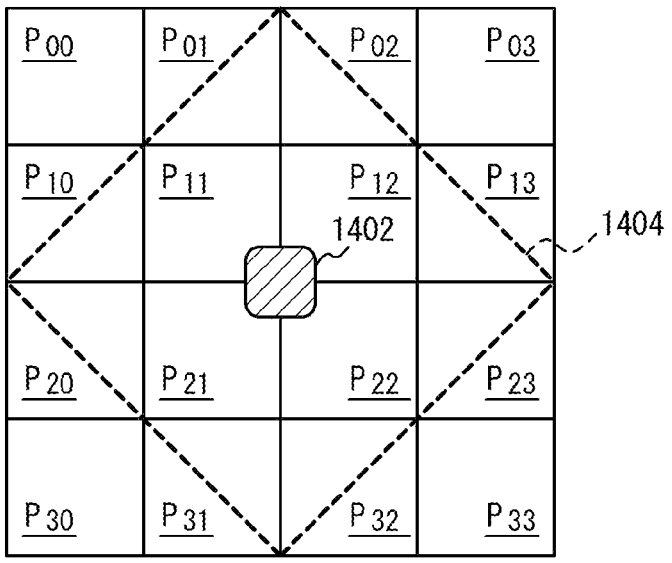
FIG. 14B shows an example calculation performed in subpixel rendering to determine a graylevel of an R subpixel, according to one or more embodiments.

FIG. 14B shows an example calculation performed in the subpixel rendering to determine the graylevel of an R subpixel 1402 in the second display region 424 based on a R reference region 1404 defined for the R subpixel 1402 as shown in FIG. 14A, according to one or more embodiments. In some embodiments, the graylevel of the R subpixel 1402 in the second display region 424 may be calculated by the second display region SPR circuit 446 (shown in FIG. 4) and incorporated in the second subpixel rendered data 449. In one embodiment, the graylevel of the R subpixel 1402 is calculated based at least in part on the R graylevels of input pixels that are at least partially overlapped by the R reference region 1404. In the shown embodiment, the graylevel of the R subpixel 1402 is calculated based at least in part on the R graylevels of 12 input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$ that are at least partially overlapped by the R reference region 1404. The calculation of the graylevel of the R subpixel 1402 may be further based on fractions of overlaps of the R reference region 1404 over the input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$.

In some embodiments, the graylevel of the R subpixel 1402 may be calculated as the γ-th root of a weighted sum of the γ-th powers of the R graylevels of input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$. In one implementation, the graylevel of the R subpixel 1402 may be calculated in accordance with the following formula (7):

$$R_{spr_1402}=(w_{01}\cdot R_{in_01}^{\gamma}+w_{02}\cdot R_{in_02}^{\gamma}+w_{10}\cdot R_{in_10}^{\gamma}+w_{11}\cdot R_{in_11}^{\gamma}+w_{12}\cdot R_{in_12}^{\gamma}+w_{13}\cdot R_{in_13}^{\gamma}+w_{20}\cdot R_{in_20}^{\gamma}+w_{21}\cdot R_{in_21}^{\gamma}+w_{22}\cdot R_{in_22}^{\gamma}+w_{23}\cdot R_{in_23}^{\gamma}+w_{31}\cdot R_{in_31}^{\gamma}+w_{32}\cdot R_{in_32}^{\gamma})^{1/\gamma} \quad (7),$$

where $R_{spr_1402}$ is the graylevel of the R subpixel 1402, $R_{in_ij}$ is the R graylevel of the input pixel $P_{ij}$, $w_{ij}$ is the weight assigned to the input pixel $P_{ij}$, and γ is the gamma value of the display system 400. In one implementation, the weight $w_{ij}$ is the ratio of the portion of the input pixel $P_{ij}$ overlapped by the R reference region 1404 to the total area of the R reference region 1404. The weights $w_{01}$, $w_{02}$, $w_{10}$, $w_{11}$, $w_{12}$, $w_{13}$, $w_{20}$, $w_{21}$, $w_{22}$, $w_{23}$, $w_{31}$, and $w_{32}$ assigned to the input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$ are determined based on fractions of overlaps of the R reference region 1404 over the input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$ respectively. In one implementation, the weights $w_{01}$, $w_{02}$, $w_{10}$, $w_{11}$, $w_{12}$, $w_{13}$, $w_{20}$, $w_{21}$, $w_{22}$, $w_{23}$, $w_{31}$, and $w_{32}$ are determined as the ratios of the areas of overlapped portions of the input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$ to the total area of the R reference region 1404, the overlapped portions of the input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$ being overlapped by the R reference region 1404.

In the embodiment shown in FIG. 14B, the ratios of the areas of the overlapped portions of the input pixels $P_{01}$, $P_{02}$, $P_{10}$, $P_{13}$, $P_{20}$, $P_{23}$, $P_{31}$, and $P_{32}$ to the total area of the R reference region 1404 are 0.0625 and the ratios of the areas of the overlapped portions of the input pixels $P_{11}$, $P_{12}$, $P_{21}$, and $P_{22}$ to the total area of the R reference region 1404 are 0.125. Accordingly, the graylevel of the R subpixel 1402 may be calculated as follows:

$$R_{spr_1402}=(0.0625R_{in_01}^{\gamma}+0.0625R_{in_02}^{\gamma}+0.0625R_{in_10}^{\gamma}+0.125R_{in_11}^{\gamma}+0.125R_{in_12}^{\gamma}+0.0625R_{in_13}^{\gamma}+0.0625R_{in_20}^{\gamma}+0.125R_{in_21}^{\gamma}+0.125R_{in_22}^{\gamma}+0.0625R_{in_23}^{\gamma}+0.0625R_{in_31}^{\gamma}+0.0625R_{in_32}^{\gamma})^{1/\gamma} \quad (8),$$

The graylevels of other R subpixels in the second display region 424 may be calculated similarly to the R subpixel 1402.

Figure 15A:
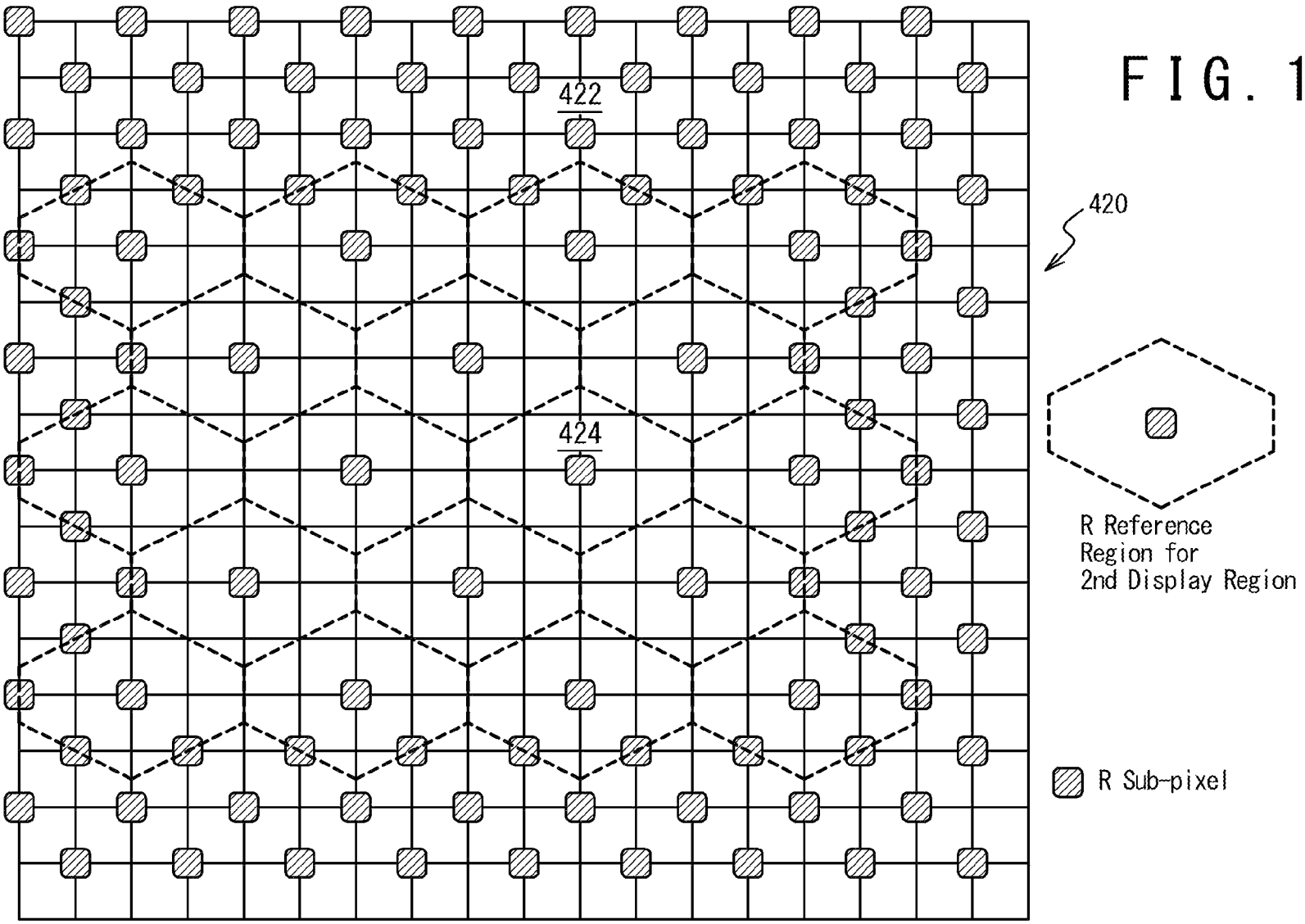
FIG. 15A shows example R reference regions defined for R subpixels, according to other embodiments.

FIG. 15A shows example R reference regions defined for the respective R subpixels in the second display region 424, according to other embodiments. In the shown embodiment, the R reference regions for the R subpixels in the second display region 424 are defined in a hexagon shape. The R reference regions are defined such that the positions of respective R reference regions map to the positions of the corresponding R subpixels in the second display region 424. In one implementation, the R reference regions may be defined such the geometric center of each R reference region is positioned on the corresponding R subpixel in the second display region 424.

Figure 15B:
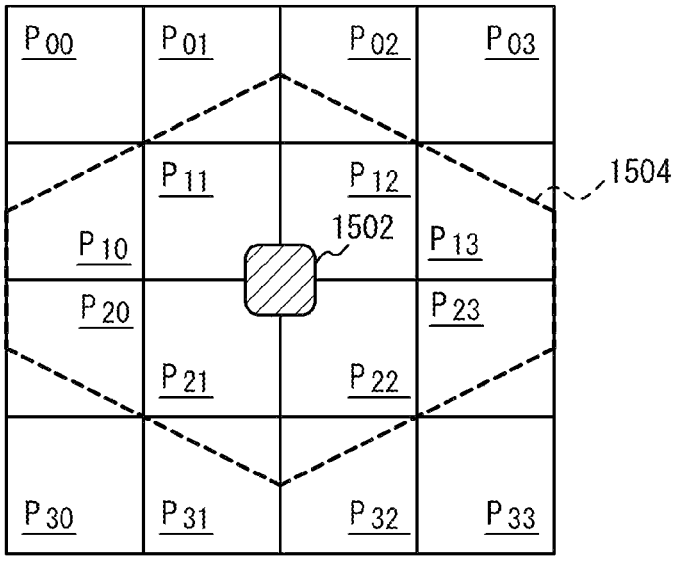
FIG. 15B shows an example calculation performed in subpixel rendering to determine a graylevel of an R subpixel, according to one or more embodiments.

FIG. 15B shows an example calculation performed in the subpixel rendering to determine the graylevel of an R subpixel 1502 in the second display region 424 based on a R reference region 1504 defined for the R subpixel 1502 as shown in FIG. 15A, according to one or more embodiments. In some embodiments, the graylevel of the R subpixel 1502 in the second display region 424 may be calculated by the second display region SPR circuit 446 (shown in FIG. 4) and incorporated in the second subpixel rendered data 449. In one embodiment, the graylevel of the R subpixel 1502 is calculated based at least in part on the R graylevels of input pixels that are at least partially overlapped by the R reference region 1504. In the shown embodiment, the graylevel of the R subpixel 1502 is calculated based at least in part on the R graylevels of 12 input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$ that are at least partially overlapped by the R reference region 1504. The calculation of the graylevel of the R subpixel 1502 may be further based on fractions of overlaps of the R reference region 1504 over the input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$.

In some embodiments, the graylevel of the R subpixel 1502 may be calculated as the γ-th root of a weighted sum of the γ-th powers of the R graylevels of input pixels $P_{01}$, $P_{02}$, $P_{10}$, $P_{11}$, $P_{12}$, $P_{13}$, $P_{20}$, $P_{21}$, $P_{22}$, $P_{23}$, $P_{31}$, and $P_{32}$. In one implementation, the graylevel of the R subpixel 1502 may be calculated in accordance with the following formula (9):

$$R_{spr_1502}=(w_{01}\cdot R_{in_01}^{\gamma}+w_{02}\cdot R_{in_02}^{\gamma}+w_{10}\cdot R_{in_10}^{\gamma}+w_{11}\cdot R_{in_11}^{\gamma}+w_{12}\cdot R_{in_12}^{\gamma}+w_{13}\cdot R_{in_13}^{\gamma}+w_{20}\cdot R_{in_20}^{\gamma}+w_{21}\cdot R_{in_21}^{\gamma}+w_{22}\cdot R_{in_22}^{\gamma}+w_{23}\cdot R_{in_23}^{\gamma}+w_{31}\cdot R_{in_31}^{\gamma}+w_{32}\cdot R_{in_32}^{\gamma})^{1/\gamma} \quad (9),$$

where $R_{spr_1502}$ is the graylevel of the R subpixel 1502, $R_{in_ij}$ is the R graylevel of the input pixel $P_{ij}$, $w_{ij}$ is the weight assigned to the input pixel $P_{ij}$, and γ is the gamma value of the display system 400. In one implementation, the weight $w_{ij}$ is the ratio of the portion of the input pixel $P_{ij}$ overlapped by the R reference region 1504 to the total area of the R reference region 1504.

In the embodiment shown in FIG. 15B, the ratios of the areas of the overlapped portions of the input pixels $P_{01}$, $P_{02}$, $P_{31}$, and $P_{32}$ to the area of the R reference region 1504 are 0.03125, the ratios of the areas of the overlapped portions of the input pixels $P_{10}$, $P_{13}$, $P_{20}$, and $P_{23}$ to the area of the reference region 1504 are 0.09375, and the ratios of the areas of the overlapped portions of the input pixels $P_{11}$, $P_{12}$, $P_{21}$, and $P_{22}$ to the area of the R reference region 1504 are 0.125. Accordingly, the graylevel of the R subpixel 1502 may be calculated as follows:

$$R_{spr_1502}=(0.03125R_{in_01}^{\gamma}+0.03125R_{in_02}^{\gamma}+0.09375R_{in_10}^{\gamma}+0.125R_{in_11}^{\gamma}+0.125R_{in_12}^{\gamma}+0.09375R_{in_13}^{\gamma}+0.09375R_{in_20}^{\gamma}+0.125R_{in_21}^{\gamma}+0.125R_{in_22}^{\gamma}+0.09375R_{in_23}^{\gamma}+0.03125R_{in_31}^{\gamma}+0.03125R_{in_32}^{\gamma})^{1/\gamma} \quad (10),$$

The graylevels of other R subpixels in the second display region 424 may be calculated similarly to the R subpixel 1502.

Figure 16:
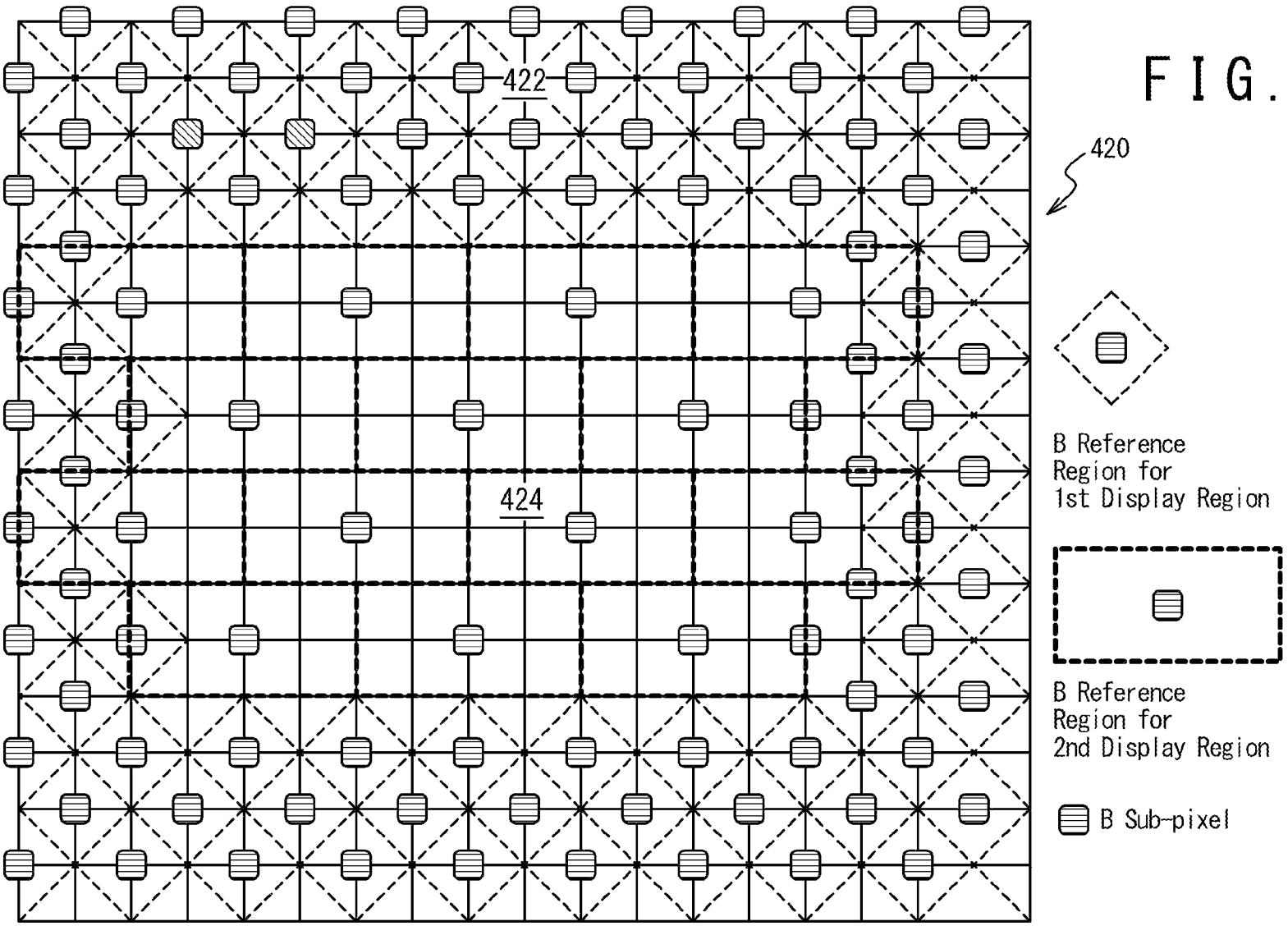
FIG. 16 shows example B reference regions defined for B subpixels of a display panel, according to one or more embodiments.

FIG. 16 shows example blue (B) reference regions defined for the respective B subpixels of the display panel 420, according to one or more embodiments. The graylevels of the B subpixels of the display panel 420 may be determined (or calculated) in a similar manner to the graylevels of the R subpixels except for that the positions of the B reference regions defined for the first display region 422 are different from the positions of the R reference regions defined for the first display region 422 and that the positions of the B reference regions defined for the second display region 424 are different from the positions of the R reference regions defined for the second display region 424. The definition of the B reference regions for the B subpixels in the first display region 422 may be indicated by the first setting 462 (shown in FIG. 4) stored in the register circuit 460 and the definition of the B reference regions for the B subpixels in the second display region 424 may be indicated by the second setting 464 (also shown in FIG. 4) stored in the register circuit 460.

The determination of the graylevels of the B subpixels of the display panel 420 involves defining a B reference region for each B subpixel of the display panel 420 and determining the graylevel of each B subpixel based at least in part on B graylevels of input pixels of the input image, the input pixels being at least partially overlapped by the B reference region. The B reference regions are defined such that the positions of respective B reference regions map to the positions of the corresponding B subpixels of the display panel 420. In one implementation, the B reference regions may be defined such that the geometric center of each B reference region is positioned on the corresponding B subpixel of the display panel 420. The shape of the B reference regions for the first display region 422 is different from the shape of the B reference regions for the second display region 424. In the embodiment shown in FIG. 16, the B reference regions for the first display region 422 are defined in a rhombic (or diamond) shape while the B reference regions for the second display region 424 are defined in a rectangular shape.

The graylevel of each B subpixel of the display panel 420 may be determined based at least in part on the B graylevels of the input pixels that are at least partially overlapped by the B reference region defined for each B subpixel of the display panel 420. The graylevels of the B subpixels in the first display region 422 may be calculated in a similar manner to the R subpixels in the first display region 422 (e.g., in accordance with the formula (1) or (2)) while the graylevels of the B subpixels in the second display region 424 may be calculated in a similar manner to the R subpixels in the second display region 424 (e.g., in accordance with the formula (3) or (4)). In some embodiments, the graylevels of the B subpixels in the first display region 422 may be determined by the first display region SPR circuit 445 (shown in FIG. 4) and incorporated in the first subpixel rendered data 448 while the graylevels of the B subpixels in the second display region 424 may be determined by the second display region SPR circuit 446 (shown in FIG. 4) and incorporated in the second subpixel rendered data 449.

Further, graylevels of boundary B subpixels may be calculated in a similar manner to boundary R subpixels (e.g., in accordance with the formula (5) or (6)), where a boundary B subpixel is such a B subpixel that the B reference region defined for the B subpixel in one of the first display region 422 and the second display region 424 overlaps one or more other B reference regions defined for one or more B subpixels in the other of the first display region 422 and the second display region 424.

Figure 17:
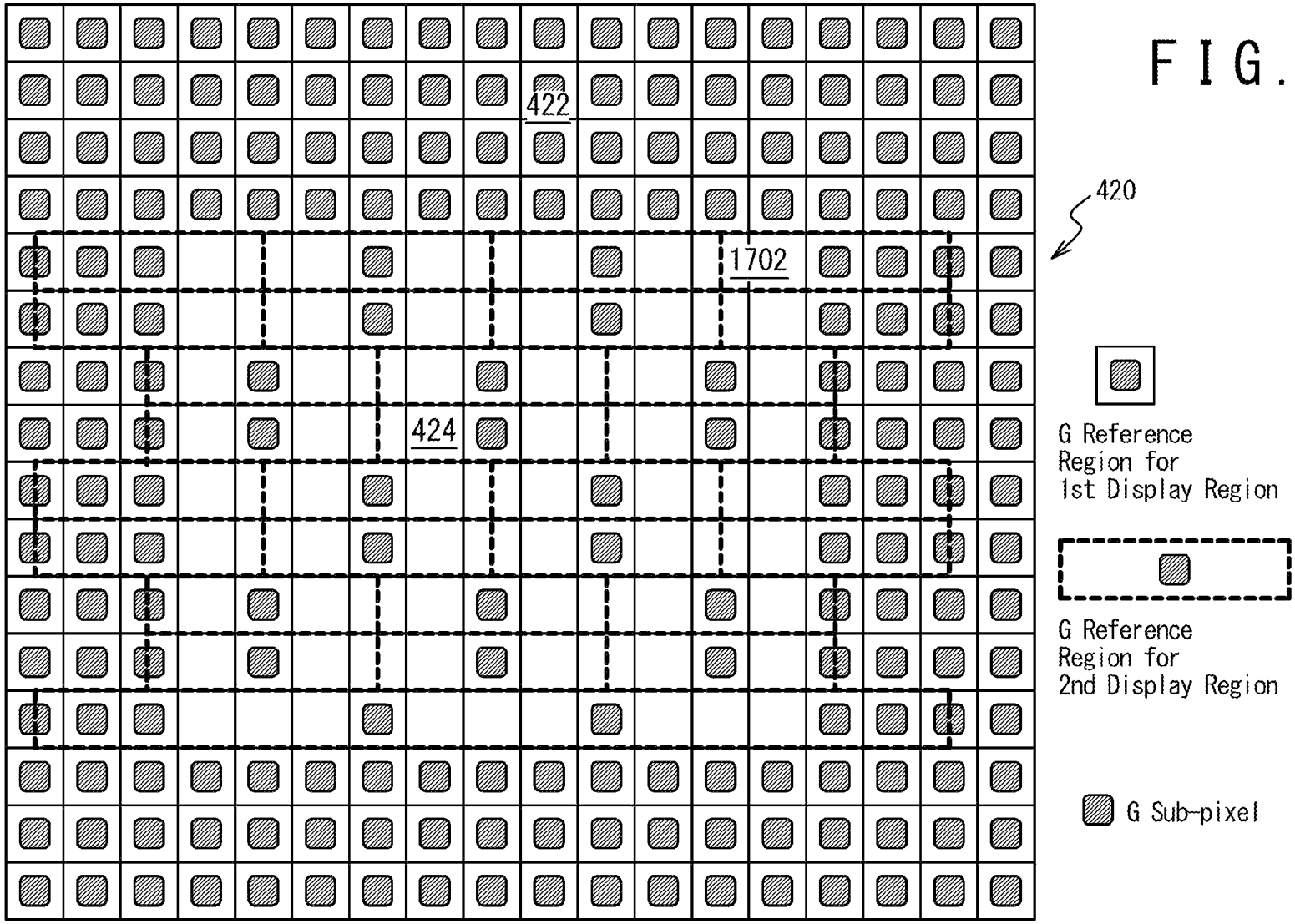
FIG. 17 shows example G reference regions defined for G subpixels of a display panel, according to one or more embodiments.

FIG. 17 shows example green (G) reference regions defined for the respective G subpixels of the display panel 420, according to one or more embodiments. In the shown embodiment, the G subpixels of the display panel 420 each correspond to one input pixel of the input image, positioned at the center of the corresponding input pixel of the input image. The definition of the G reference regions for the G subpixels in the first display region 422 may be indicated by the first setting 462 (shown in FIG. 4) stored in the register circuit 460 and the definition of the G reference regions for the G subpixels in the second display region 424 may be indicated by the second setting 464 (also shown in FIG. 4) stored in the register circuit 460.

The determination of the graylevels of the G subpixels of the display panel 420 involves defining a G reference region for each G subpixel of the display panel 420 and determining the graylevel of each G subpixel based at least in part on the G graylevel(s) of one or more input pixels of the input image, the one or more input pixels being at least partially overlapped by the G reference region. The G reference regions are defined such that the positions of respective G reference regions map to the positions of the corresponding G subpixels of the display panel 420. In one implementation, the G reference regions may be defined such the geometric center of each G reference region is positioned on the corresponding G subpixel of the display panel 420. The shape of the G reference regions for the first display region 422 is different from the shape of the G reference regions for the second display region 424.

In the embodiment shown in FIG. 17, the G reference region of each G subpixel in the first display region 422 may be defined as the input pixel corresponding to each G subpixel. In such embodiments, the graylevel of each G subpixel in the first display region 422 is determined as the G graylevel of the corresponding input pixel. In some embodiments, the graylevel of the G subpixels in the first display region 422 may be determined by the first display region SPR circuit 445 (shown in FIG. 4) and incorporated in the first subpixel rendered data 448.

Further, the G reference region of each G subpixel in the second display region 424 is defined in a rectangular shape to overlap five input pixels. The graylevel of each G subpixel in the second display region 424 may be determined based at least in part on the G graylevels of the five input pixels that are at least partially overlapped by the G reference region defined for each G subpixel in the second display region 424. The graylevels of the G subpixels in the second display region 424 may be calculated in a similar manner to the R subpixels in the second display region 424 (e.g., in accordance with the formula (3) or (4)).

Figure 18:
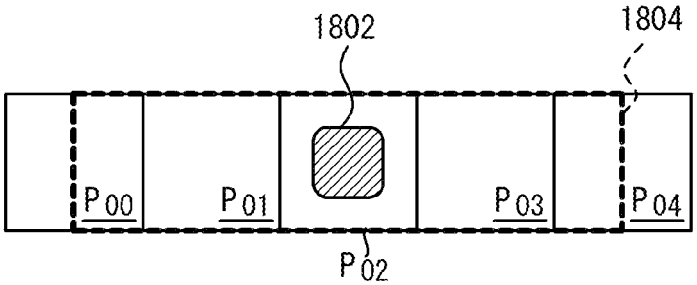
FIG. 18 shows an example calculation performed in subpixel rendering to determine a graylevel of an G subpixel, according to one or more embodiments.

FIG. 18 shows an example calculation performed in the subpixel rendering to determine the graylevel of a G subpixel 1802 in the second display region 424 based on a G reference region 1804 defined for the G subpixel 1802 as shown in FIG. 17, according to one or more embodiments. In some embodiments, the graylevel of the G subpixel 1802 in the second display region 424 may be calculated by the second display region SPR circuit 446 (shown in FIG. 4) and incorporated in the second subpixel rendered data 449. In one embodiment, the graylevel of the G subpixel 1802 is calculated based at least in part on the G graylevels of input pixels that are at least partially overlapped by the G reference region 1804. In the shown embodiment, the graylevel of the G subpixel 1802 is calculated based at least in part on the G graylevels of five input pixels $P_{00}$, $P_{01}$, $P_{02}$, $P_{03}$, and $P_{04}$ that are at least partially overlapped by the G reference region 1804. The calculation of the graylevel of the G subpixel 1802 may be further based on fractions of overlaps of the G reference region 1804 over the input pixels $P_{00}$, $P_{01}$, $P_{02}$, $P_{03}$, and $P_{04}$.

In some embodiments, the graylevel of the G subpixel 1802 may be calculated as the γ-th root of a weighted sum of the γ-th powers of the G graylevels of input pixels $P_{00}$, $P_{01}$, $P_{02}$, $P_{03}$, and $P_{04}$. In one implementation, the graylevel of the G subpixel 1802 may be calculated in accordance with the following formula (11):

$$G_{spr_1802}=(w_{00}\cdot G_{in_00}^{\gamma}+w_{01}\cdot G_{in_01}^{\gamma}+w_{02}\cdot G_{in_02}^{\gamma}+w_{03}\cdot G_{in_03}^{\gamma}+w_{04}\cdot G_{in_04}^{\gamma})^{1/\gamma} \quad (11),$$

where $G_{spr_1802}$ is the graylevel of the G subpixel 1802, $G_{in_ij}$ is the G graylevel of the input pixel $P_{ij}$, $w_{ij}$ is the weight assigned to the input pixel $P_{ij}$, and γ is the gamma value of the display system 400. In one implementation, the weight $w_{ij}$ is the ratio of the portion of the input pixel $P_{ij}$ overlapped by the G reference region 1804 to the total area of the G reference region 1804. The weights $w_{00}$, $w_{01}$, $w_{02}$, $w_{03}$, and $w_{04}$ assigned to the input pixels $P_{00}$, $P_{01}$, $P_{02}$, $P_{03}$, and $P_{04}$ are determined based on fractions of overlaps of the G reference region 1804 over the input pixels $P_{00}$, $P_{01}$, $P_{02}$, $P_{03}$, and $P_{04}$, respectively. In one implementation, the weights $w_{00}$, $w_{01}$, $w_{02}$, $w_{03}$, and $w_{04}$ are determined as the ratios of the areas of overlapped portions of the input pixels $P_{00}$, $P_{01}$, $P_{02}$, $P_{03}$, and $P_{04}$ to the total area of the G reference region 1804, the overlapped portions of the input pixels $P_{00}$, $P_{01}$, $P_{02}$, $P_{03}$, and $P_{04}$ being overlapped by the G reference region 1804.

In the embodiment shown in FIG. 18, the ratios of the areas of the overlapped portions of the input pixels $P_{00}$ and $P_{04}$ to the area of the G reference region 1804 are 0.125 and the ratios of the areas of the overlapped portions of the input pixels $P_{01}$, $P_{02}$, and $P_{03}$ to the area of the G reference region 1804 are 0.25. Accordingly, the graylevel of the G subpixel 1802 may be calculated as follows:

$$G_{spr_1802}=(0.125G_{in_00}^{\gamma}+0.25G_{in_01}^{\gamma}+0.25G_{in_02}^{\gamma}+0.25G_{in_03}^{\gamma}+0.125G_{in_04}^{\gamma})^{1/\gamma} \quad (12),$$

The graylevels of other G subpixels in the second display region 424 may be calculated similarly to the G subpixel 1802.

A G reference region defined for a G subpixel in the second display region 424 may overlap one or more G reference regions defined for one or more G subpixels in the first display region 422. If a G reference region defined for a G subpixel in the second display region 424 overlaps one or more other G reference regions defined for one or more G subpixels in the first display region 422, such a G subpixel may be hereinafter referred to as boundary G subpixel.

Figure 19:
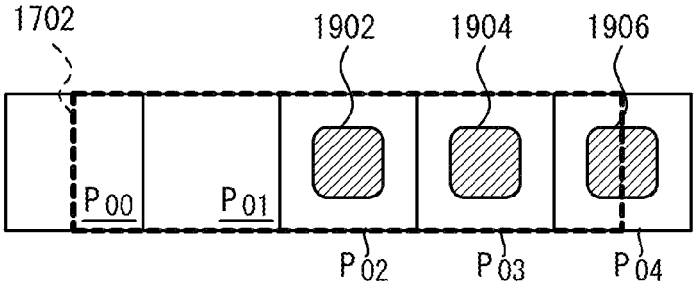
FIG. 19 shows an example G reference region defined for a boundary G subpixel, according to one or more embodiments.

FIG. 19 shows an example G reference region 1702 (also shown in FIG. 17) defined for a boundary G subpixel 1902 in the second display region 424 at the boundary between the first display region 422 and the second display region 424, according to one or more embodiments. In the shown embodiment, the G reference region 1702 at least partially overlaps G reference regions defined for G subpixels 1904 and 1906 (i.e., the input pixels $P_{03}$ and $P_{04}$) in the first display region 422. The overlap of the G reference region 1702 over the G reference regions defined for G subpixels 1904 and 1906 may cause an image artifact at the boundary between the first display region 422 and the second display region 424.

To mitigate the image artifact at the boundary between the first display region 422 and the second display region 424, in one or more embodiments, boundary compensation coefficients are applied to the graylevels of at least some of the boundary G subpixels in the second display region 424. The boundary compensation coefficients may be empirically predetermined and stored in the register circuit 460 as part of the boundary compensation coefficients 468 as shown in FIG. 4.

In one implementation, the graylevels of the boundary G subpixels in the second display region 424 may be determined by first determining base graylevels of boundary G subpixels as the γ-th roots of weighted sums of the γ-th powers of the G graylevels of the corresponding input pixels as described above (e.g., in accordance with the above-described formula (11) or (12)) and determining the final graylevels of the boundary G subpixels by applying boundary compensation coefficients to the base graylevels. In one implementation, the second display region SPR circuit 446 (shown in FIG. 4) may be configured to generate the second subpixel rendered data 449 such that the second subpixel rendered data 449 incorporates the base graylevels of the boundary G subpixels in the second display region 424 and the combiner circuit 447 may be configured to apply the boundary compensation coefficients to the base graylevels of the boundary G subpixels in the second display region 424 to determine the final graylevels of the boundary G subpixels. The combiner circuit 447 may be further configured to incorporate the final graylevels of the boundary G subpixels into the resulting subpixel rendered data 415.

For the boundary G subpixel 1902 in the second display region 424 shown in FIG. 19, for example, a base graylevel of the boundary G subpixel 1902 is determined as the γ-th root of a weighted sum of the γ-th powers of the R graylevels of input pixels $P_{00}$, $P_{01}$, $P_{02}$, $P_{03}$, and $P_{04}$ which are overlapped by the G reference region 1702 defined for the boundary G subpixel 1902. In one implementation, the base graylevel of the boundary G subpixel 1902 is determined as follows:

$$G_{base_1902}=(0.125G_{in_00}^{\gamma}+0.25G_{in_01}^{\gamma}+0.25G_{in_02}^{\gamma}+0.25G_{in_03}^{\gamma}+0.125G_{in_04}^{\gamma})^{1/\gamma} \quad (13),$$

where $G_{base_1902}$ is the base graylevel of the boundary G subpixel 1902. The final graylevel of the boundary G subpixel 1902 may be determined by applying a boundary compensation coefficient determined for the boundary G subpixel 1902. In some embodiments, the final graylevel of the boundary G subpixel 1902 is determined by multiplying the base graylevel $G_{base_1902}$ of the boundary G subpixel 1902 by the boundary compensation coefficient determined for the boundary G subpixel 1902. In such embodiments, the final graylevel $G_{spr_1902}$ of the boundary G subpixel 1902 is determined as:

$$G_{spr_1902}=\eta_G \cdot G_{base_1902}, \quad (14)$$

where $\eta_G$ is the boundary compensation coefficient determined for the boundary G subpixel 1902. In one implementation, the boundary compensation coefficient $\eta_G$ for the boundary G subpixel 1902 may be empirically determined and stored in the register circuit 460 as part of the boundary compensation coefficients 468. The graylevels of other boundary G subpixels in the second display region 424 may be calculated similarly to the boundary G subpixel 1902.

Figure 20:
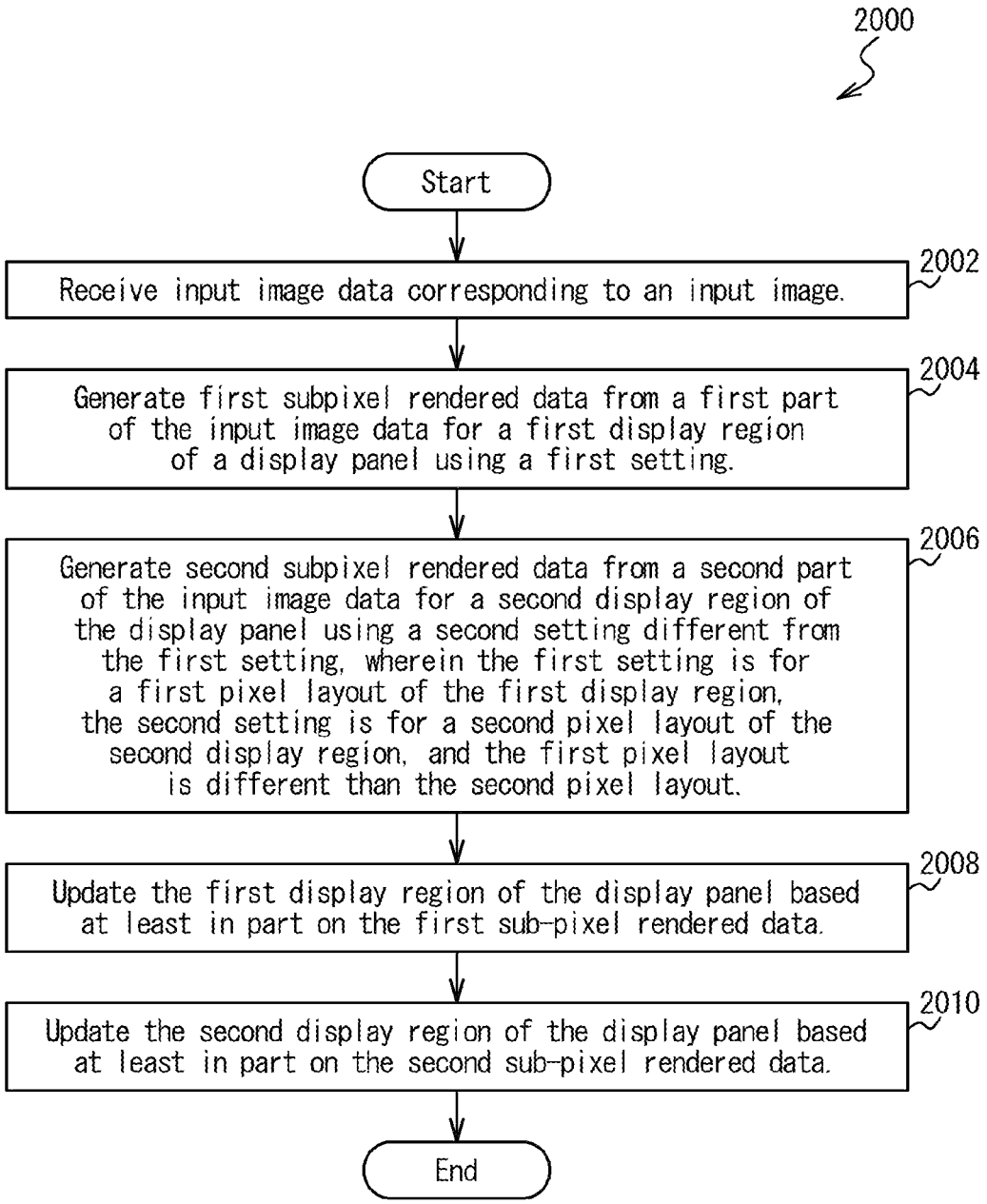
FIG. 20 illustrates example steps for driving a display panel, according to one or more embodiments.

Method 2000 of FIG. 20 illustrates example steps for driving a display panel (e.g., the display panels 120, 270, 300, and 420 of FIGS. 1 to 4), according to one or more embodiments. It is noted that one or more of the steps illustrated in FIG. 20 may be omitted, repeated, and/or performed in a different order than the order illustrated in FIG. 20. It is further noted that two or more steps may be implemented at the same time.

The method 2000 includes receiving input image data (e.g., the image data 112 of FIG. 1, the input image data 210 of FIG. 2, and the image data 412 of FIG. 4) corresponding to an input image at step 2002. The method 2000 further includes generating first subpixel rendered data (e.g., the low pixel density region output 223 of FIG. 2 and the first subpixel rendered data 448 of FIG. 4) from a first part of the input image data for a first display region (e.g., the first display regions 122 and 422 of FIGS. 1 and 4 and the nominal pixel density region 310 of FIG. 3) of the display panel using a first setting (e.g., the first setting 162 of FIG. 1, the setting 231 of FIG. 2, and the first setting 462 of FIG. 4) at step 2004. Generating the first subpixel rendered data may include applying subpixel rendering to the first part of the input image data for the first display region.

The method 2000 further includes generating second subpixel rendered data (e.g., the nominal pixel density region output 225 of FIG. 2 and the second subpixel rendered data 449 of FIG. 4) from a second part of the input image data for a second display region (e.g., the second display regions 124 and 424 of FIGS. 1 and 4 and the low pixel density regions 271 and 320 of FIGS. 2 and 3) of the display panel using a second setting (e.g., the second setting 164 of FIG. 1, the setting 232 of FIG. 2, and the second setting 464 of FIG. 4) at step 2006. Generating the second subpixel rendered data may include applying subpixel rendering to the second part of the input image data for the second display region. The second setting is different from the first setting. The first setting is for a first pixel layout of the first display region and the second setting is for a second pixel layout of the second display region, where the first pixel layout is different than the second pixel layout.

The method 2000 further includes updating the first display region of the display panel based at least in part on the first subpixel rendered data at step 2008. The method 2000 further includes updating the second display region of the display panel based at least in part on the second subpixel rendered data at step 2010.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

an image processing circuit configured to:

receive input image data corresponding to an input image, generate first subpixel rendered data from a first part of the input image data for a first display region of a display panel using a first setting, and generate second subpixel rendered data from a second part of the input image data for a second display region of the display panel using a second setting different from the first setting, apply a boundary compensation coefficient to a boundary pixel in a boundary region defined between the first display region and the second display region, wherein the boundary pixel is defined as being in the boundary region based on a location setting value assigned to the boundary pixel, wherein the first setting is for a first pixel layout of the first display region, the second setting is for a second pixel layout of the second display region, wherein the first pixel layout is different than the second pixel layout, wherein the boundary compensation coefficient is applied to a first subpixel of the boundary pixel, and wherein a second subpixel of the boundary pixel and a third subpixel of the boundary pixel comprise additional boundary compensation coefficients different than the boundary compensation coefficient applied to the first subpixel; and a driver circuit configured to:

update the first display region of the display panel based at least in part on the first subpixel rendered data, and update the second display region of the display panel based at least in part on the second subpixel rendered data.

2. The display driver of claim 1, wherein generating the first subpixel rendered data comprises:

defining a first reference region on the input image based at least in part on the first setting and a position of a first subpixel in the first display region of the display panel, determining a first graylevel of the first subpixel based at least in part on a graylevel of a first pixel of the input image, the first pixel being at least partially overlapped by the first reference region, and wherein generating the second subpixel rendered data comprises:

defining a second reference region on the input image based at least in part on the second setting and a position of a second subpixel in the second display region of the display panel, and determining a second graylevel of the second subpixel based at least in part on a graylevel of a second pixel of the input image, the second pixel being at least partially overlapped by the second reference region.

3. The display driver of claim 2, wherein the first setting and the second setting are defined such that a shape of the first reference region is different from a shape of the second reference region.

4. The display driver of claim 2, wherein a pixel density of the first display region is higher than a pixel density of the second display region, and wherein the first setting and the second setting are defined such that an area of the second reference region is larger than an area of the first reference region.

5. The display driver of claim 2, wherein determining the second graylevel of the second subpixel in the second display region of the display panel comprises determining a fraction of overlap of the second reference region over the second pixel, and wherein determining the second graylevel of the second subpixel is further based on the fraction.

6. The display driver of claim 1, wherein generating the first subpixel rendered data comprises:

defining a first reference region on the input image based at least in part on the first setting and a position of a first subpixel in the first display region of the display panel, wherein generating the second subpixel rendered data comprises:

defining a third reference region on the input image based on the second setting and a position of a boundary subpixel in the second display region of the display panel such that the third reference region partially overlaps the first reference region;

determining a base graylevel of the boundary subpixel based at least in part on a graylevel of a third pixel of the input image, the third pixel being at least partially overlapped by the third reference region; and determining a third graylevel of the boundary subpixel by applying the boundary compensation coefficient to the base graylevel.

7. The display driver of claim 6, wherein generating the second subpixel rendered data further comprises determining the boundary compensation coefficient based at least in part on the position of the boundary subpixel.

8. The display driver of claim 6, wherein generating the second subpixel rendered data further comprises selecting the boundary compensation coefficient from among a plurality of boundary compensation coefficients stored in a register circuit based at least in part on the position of the boundary subpixel.

9. The display driver of claim 1, wherein the boundary compensation coefficient applies only the boundary pixel and to one or more additional boundary pixels in the boundary region.

10. The display driver of claim 1, wherein:

the first subpixel comprises a red subpixel of the boundary pixel, the second subpixel comprises a blue subpixel of the boundary pixel, and the third subpixel comprises a green subpixel of the boundary pixel.

11. A display device, comprising:

a display panel comprising:

a first display region with a first pixel layout; and a second display region with a second pixel layout different than the first pixel layout; and a display driver configured to:

receive input image data corresponding to an input image to be displayed on the display panel, generate first subpixel rendered data from a first part of the input image data for the first display region using a first setting for the first pixel layout of the first display region, generate second subpixel rendered data from a second part of the input image data for the second display region using a second setting for the second pixel layout of the first display region, wherein the second setting is different from the first setting, apply a boundary compensation coefficient to a boundary pixel in a boundary region defined between the first display region and the second display region, wherein the boundary pixel is defined as being in the boundary region based on a location setting value assigned to the boundary pixel, wherein the boundary compensation coefficient is applied to a first subpixel of the boundary pixel, and wherein a second subpixel of the boundary pixel and a third subpixel of the boundary pixel comprise additional boundary compensation coefficients different than the boundary compensation coefficient applied to the first subpixel, update the first display region of the display panel based at least in part on the first subpixel rendered data, and update the second display region of the display panel based at least in part on the second subpixel rendered data.

12. The display device of claim 11, wherein generating the first subpixel rendered data comprises:

defining a first reference region on the input image based at least in part on the first setting and a position of a first subpixel in the first display region of the display panel, determining a first graylevel of the first subpixel based at least in part on a graylevel of a first pixel of the input image, the first pixel being at least partially overlapped by the first reference region, and wherein generating the second subpixel rendered data comprises:

defining a second reference region on the input image based at least in part on the second setting and a position of a second subpixel in the second display region of the display panel, and determining a second graylevel of the second subpixel based at least in part on a graylevel of a second pixel of the input image, the second pixel being at least partially overlapped by the second reference region.

13. The display device of claim 12, wherein the first setting and the second setting are defined such that a shape of the first reference region is different from a shape of the second reference region.

14. The display device of claim 12, wherein a pixel density of the first display region is higher than a pixel density of the second display region, and wherein the first setting and the second setting are defined such that an area of the second reference region is larger than an area of the first reference region.

15. The display device of claim 12, wherein determining the second graylevel of the second subpixel in the second display region of the display panel comprises determining a fraction of an overlap of the second reference region over the second pixel, and wherein determining the second graylevel of the second subpixel is further based on the fraction.

16. The display device of claim 11, wherein generating the first subpixel rendered data comprises:

defining a first reference region on the input image based at least in part on the first setting and a position of a first subpixel in the first display region of the display panel, wherein generating the second subpixel rendered data comprises:

defining a third reference region on the input image based at least in part on the second setting and a position of a boundary subpixel in the second display region of the display panel such that the third reference region partially overlaps the first reference region;

determining a base graylevel of the boundary subpixel based at least in part on a graylevel of a third pixel of the input image, the third pixel being at least partially overlapped by the third reference region; and determining a third graylevel of the boundary subpixel by applying the boundary compensation coefficient to the base graylevel.

17. The display device of claim 16, wherein generating the second subpixel rendered data further comprises determining the boundary compensation coefficient based at least in part on the position of the boundary subpixel.

18. The display device of claim 16, wherein generating the second subpixel rendered data further comprises selecting the boundary compensation coefficient from among a plurality of boundary compensation coefficients stored in a register circuit based at least in part on the position of the boundary subpixel.

19. A method, comprising:

receiving input image data corresponding to an input image;

generating first subpixel rendered data from a first part of the input image data for a first display region of a display panel using a first setting;

generating second subpixel rendered data from a second part of the input image data for a second display region of the display panel using a second setting different from the first setting, wherein the first setting is for a first pixel layout of the first display region, the second setting is for a second pixel layout of the second display region, wherein the first pixel layout is different than the second pixel layout;

applying a boundary compensation coefficient to a boundary pixel in a boundary region defined between the first display region and the second display region, wherein the boundary pixel is defined as being in the boundary region based on a location setting value assigned to the boundary pixel, wherein the boundary compensation coefficient is applied to a first subpixel of the boundary pixel, and wherein a second subpixel of the boundary pixel and a third subpixel of the boundary pixel comprise additional boundary compensation coefficients different than the boundary compensation coefficient applied to the first subpixel, updating the first display region of the display panel based at least in part on the first subpixel rendered data; and updating the second display region of the display panel based at least in part on the second subpixel rendered data.

20. The method of claim 19, wherein generating the first subpixel rendered data comprises:

defining a first reference region on the input image based at least in part on the first setting and a position of a first subpixel in the first display region of the display panel, determining a first graylevel of the first subpixel based at least in part on a graylevel of a first pixel of the input image, the first pixel being at least partially overlapped by the first reference region, and wherein generating the second subpixel rendered data comprises:

defining a second reference region on the input image based at least in part on the second setting and a position of a second subpixel in the second display region of the display panel, and determining a second graylevel of the second subpixel based at least in part on a graylevel of a second pixel of the input image, the second pixel being at least partially overlapped by the second reference region.

21. The method of claim 20, wherein the first setting and the second setting are defined such that a shape of the first reference region is different from a shape of the second reference region.

22. The method of claim 19, wherein generating the first subpixel rendered data comprises:

defining a first reference region on the input image based at least in part on the first setting and a position of a first subpixel in the first display region of the display panel, wherein generating the second subpixel rendered data further comprises:

defining a third reference region on the input image based at least in part on the second setting and a position of a boundary subpixel in the second display region of the display panel such that the third reference region partially overlaps the first reference region;

determining a base graylevel of the boundary subpixel based at least in part on a graylevel of a third pixel of the input image, the third pixel being at least partially overlapped by the third reference region; and determining a third graylevel of the boundary subpixel by applying the boundary compensation coefficient to the base graylevel.

* * * * *